US005733433A

United States Patent [19]

Lee et al.

[11] Patent Number: 5,733,433

[45] Date of Patent: Mar. 31, 1998

[54] HEAT GENERATING TYPE INK-JET PRINT HEAD

[76] Inventors: Ho Jun Lee; Hi Deok Lee; Jae Duk Lee; Jun Bo Yoon; Ki Ho Han; Jae Kwan Kim, all of 373-1, Kusung-Dong,Yusung-Ku; Chul Hi Han, Manul Apt. 103-502, Shinsung 1-Block, Yusung-ku; Choong Ki Kim, Kit Gyosu Apt. 15-202, 236-2, Gajeong-Dong, Yusung-ku, all of Daejeon; Doo Won Seo, 301-15, Chamshilbon-Dong, Sangpa-ku, Seoul, all of Rep. of Korea

[21] Appl. No.: 475,536

[22] Filed: Jun. 7, 1995

[30] Foreign Application Priority Data

Dec. 29, 1994 [KR] Rep. of Korea ..... 94 38471

[51] Int. Cl.[6] ..... C25F 3/14; C25F 3/16

[52] U.S. Cl. ..... 205/665; 205/666; 205/667; 205/684; 205/685

[58] Field of Search ..... 205/665, 666, 205/674, 684, 685, 667

[56] References Cited

U.S. PATENT DOCUMENTS

| | | | |
|---|---|---|---|
| 5,406,318 | 4/1995 | Moore et al. | 205/645 X |
| 5,565,084 | 10/1996 | Lee et al. | 205/646 |
| 5,574,486 | 11/1996 | Whitlow et al. | 205/646 X |

*Primary Examiner*—Donald R. Valentine

*Attorney, Agent, or Firm*—Jacobson, Price, Holman & Stern, PLLC

[57] ABSTRACT

A heat generating type ink-jet print head including an ink supply passage for receiving an ink from an ink container, a micro chamber for storing the ink and nozzles, all being directly formed on a substrate, and a method for fabricating the ink-jet print head using an electrolytic polishing process, and a method for fabricating the ink-jet print head. The ink-jet print head is fabricated using an electrolytic polishing process, thereby achieving an accurate and inexpensive fabrication.

33 Claims, 24 Drawing Sheets

HEAT GENERATING TYPE INK-JET PRINT HEAD

BACKGROUND OF THE INVENTION

1. Field of the Invention

The present invention relates to an ink-jet printer, and more particularly to a heat generating type ink-jet print head including an ink supply passage for receiving ink from an ink container, a micro chamber for storing the ink and nozzles, all being directly formed on a substrate, and a method for fabricating the ink-jet print head using the electrolytic polishing process.

2. Description of the Prior Art

The expanded use of computers has resulted in an abrupt increase in the requirement of inexpensive printers having a superior performance. Heat generating type ink-jet printers have been known as satisfying the above requirement on the basis of the following reason. Such heat generating type ink-jet printers have the advantages of easy application to a digital computer, high resolution, high speed, color printing function and low cost, as compared to dot matrix printers and laser printers.

An ink-jet printer is most suitable for a portable computer because of its low requirement of energy per dot as compared to other printer systems and no requirement of any small and heavy mechanical elements. An ink-jet printer also has the advantages of the elimination of noise by virtue of its non-impact system, reduced cost by virtue of consumption of ink only as dots require, easy maintenance and high applicability to technical fields by virtue of its non-contact system.

Of various elements constituting such heat generating type ink-jet printers, the highest value-added and technology-intensive ones are ones with the head adapted to inject the ink.

If there is no independent fabrication and design capability for ink-jet print heads, then it is impossible to independently design other elements (additionally, mechatronics and software) constituting a printer. In the case of ink-jet printers, therefore, the independent fabrication and design capability for ink-jet print heads is very important.

Hewlett Packard Company in the U.S.A. and Canon Company in Japan are the leading companies in producing heat generating type ink-jet print heads. Although products made by these companies are operated in the same principle manner, they have a difference in the ink injection direction. That is, the product made by Hewlett Packard Company has an upward ink injection direction, while the product made by Canon Company has a lateral ink injection direction. Although the products of both companies have individual advantages and disadvantages, the present invention embodies a heat generating type ink-jet print head having the upward ink injection direction, as in the product of Hewlett Packard Company, using an electrolytic polishing process.

Now, a heat generating type ink-jet print head produced by Hewlett Packard Company will be described in conjunction with FIG. 1.

As shown in FIG. 1, the head is attached at its lower surface to the upper surface of a ink container 1. The head includes the main ink supply passage 2, vertically extending throughout a substrate of the head and serving to supply ink from the ink container 1 towards the upper surface of the head. The head also includes an assistant ink supply passage 3 communicating with the main ink supply passage 2. The assistant ink supply passage 3 serves to supply the ink from the main ink supply passage 2 to a micro-chamber 4. The head also includes a nozzle 5 for injecting the ink contained in the micro-chamber 4 onto a sheet 13.

The ink injection is achieved as a heat generating resistor film 6, formed on the micro-chamber 4, generates a thermal energy which, in turn, abruptly expands the volume of the ink. To this end, the head has a wiring for applying the electrical energy to the heat generating resistor film 6 and a pad 8 for coupling the wire 7 to an external energy source.

The head also includes a protection film 9 as an non-conductor and a protection film 10 as a metal film in order to protect the heat generating resistor film 6 and the wire 7 from mechanical impact generated upon the ink injection and an erosion caused by the ink. A thermal insulating film 11 is formed beneath the heat generating resistor film 6 so as to efficiently use the heat generated at the heat generating resistor film 6 as the ink injection energy. The micro-chamber 4 is defined by a thermal insulator 12.

This conventional head, having the above-mentioned structure, is fabricated using the method including the steps of forming constituting elements of the head up to the micro-chamber on the substrate, forming the main ink supply passage using a laser or sand striking process, and then covering a nozzle plate, provided with the nozzle, over the resulting structure obtained after the formation of the main ink supply passage.

However, this fabrication method has the following problems.

First, it involves high manufacturing costs because it uses expensive laser equipment and specific equipment for arranging the nozzle plate and the substrate.

Second, it involves low productivity because the formation of the main ink supply passage and the covering of the nozzle plate are not carried out by the unit of wafer, but carried out by the unit of head.

Third, it involves severe generation of dust and crack and the difficulty in fabricating a high resolution and wide-width ink-jet print head having a smaller-size main ink supply passage because the main ink supply passage is mechanically formed.

SUMMARY OF THE INVENTION

Therefore, the object of the invention is to solve the above-mentioned problems encountered in the prior art, and thus, to provide a heat generating type ink-jet print head having a precise and inexpensive structure exhibiting a superior performance, and a method for fabricating the heat generating type ink-jet print head using an electrolytic polishing process.

In accordance with one aspect, the present invention provides a heat-generating type ink-jet print head fabricated using an electrolytic polishing process, comprising: a substrate provided with a main ink supply passage having a cross-section with a wide and gentle lower portion and a narrow and sharp upper portion; a heat-generating resistor film and a wiring sequentially formed on the substrate; a T-shaped metal structure fixedly disposed over the substrate such that its lower surface facing the main ink supply passage is flush with the upper surface of the substrate; an assistant ink supply passage and a micro-chamber both formed in the space defined between the metal structure and the substrate; an upwardly-opened nozzle connected to the micro-chamber; and an insulating film adapted to fixedly mount the metal structure to the substrate.

In accordance with another aspect, the present invention provides a heat-generating type ink-jet print head fabricated using an electrolytic polishing process, comprising: a substrate provided with a main ink supply passage having a cross-section with a wide and gentle lower portion and a narrow and sharp upper portion; an impurity diffusion layer and an insulating film sequentially formed on the substrate; a heat-generating resistor film and a wiring sequentially formed on the insulating film; a first metal structure fixed to the substrate by the insulating film and electrically connected to a grounding wire of the wiring; a second metal structure disposed adjacent to the first metal structure, the second metal structure extending in parallel to the substrate such that it defines an assistant ink supply passage and a micro-chamber above the main ink supply passage inside the main ink supply passage; and a nozzle connected to the micro-chamber, the nozzle extending throughout the second metal structure.

In accordance with another aspect, the present invention provides a method for fabricating a heat-generating type ink-jet print head using an electrolytic polishing process, comprising the steps of: forming a non-conductive, first insulating film over a substrate, etching a portion of the first insulating film corresponding to a region where a main ink supply passage is to be formed, thereby forming a first window, and then forming a boron-doped layer on a portion of the substrate exposed through the first window; sequentially forming a heat-generating resistor film and a wiring on a predetermined portion of the first insulating film such that metal films respectively constituting the heat-generating resistor film and wiring are partially disposed in the first window for an electrical connection to the substrate; sequentially forming a non-conductive, first protection film, a metal, second protection film and a non-conductive, second insulating film over the entire exposed surface of the resulting structure obtained after the formation of the wiring, and then locally etching the second insulating film and the second protection film, thereby exposing the main ink supply passage region and a predetermined portion of the first protection film; locally etching the exposed portion of the first protection film, thereby forming second windows respectively at the main ink supply passage region and a region where the wiring is exposed; forming a seed metal film over the entire exposed surface of the resulting structure obtained after the formation of the second windows, thereby forming pads electrically connected to the wiring; forming a sacrificial material pattern on a predetermined portion of the resulting structure obtained after the formation of the pads, and electroplating an electroplating film on a predetermined portion of the seed metal film, such that the electroplating film is provided with a third window at a region where a nozzle is to be formed; removing a portion of the resulting structure obtained after the formation of the third window, which portion is disposed over the main ink supply passage region, by an etching using the electrolytic polishing process, and then removing the sacrificial material pattern; and removing exposed portions of the seed metal film, second insulating film and second protection film, thereby forming an assistant ink supply passage and a micro-chamber together with the nozzle, whereby a micro ink supply structure extending from the main ink supply passage to the nozzle via the assistant ink supply passage and the micro-chamber is formed.

In accordance with another aspect, the present invention provides a method for fabricating a heat-generating type ink-jet print head using an electrolytic polishing process, comprising the steps of: sequentially forming a buffer film and a silicon nitride film on a portion of a substrate corresponding to a region where a main ink supply passage is to be formed, and forming an impurity diffusion layer on the other portion of the substrate; forming a first insulating film over the impurity diffusion layer, removing the silicon nitride film and the buffer film, thereby forming a first window, and then forming a boron-doped layer on the portion of the substrate exposed through the first window; sequentially forming a heat-generating resistor film and a wiring on a predetermined portion of the first insulating film, such that metal films respectively constituting the heat-generating resistor film and wiring are partially disposed in the first window for an electrical connection to the substrate; sequentially forming a non-conductive, first protection film, a metal, second protection film and a non-conductive, second insulating film over the entire exposed surface of the resulting structure obtained after the formation of the wiring, and then partially removing the second insulating film and second protection film, thereby exposing the main ink supply passage region and a predetermined portion of the first protection film; locally etching the exposed portion of the first protection film, thereby forming second windows respectively at the main ink supply passage region and a region where the wiring is exposed; sequentially forming a first seed metal film and a first sacrificial material pattern over the entire exposed surface of the resulting structure obtained after the formation of the second windows, and then removing a portion of the first sacrificial material pattern disposed over a predetermined portion of the first seed metal film; forming an electroplating film over the exposed predetermined portion of the first seed metal film; forming a second seed metal film over the resulting structure obtained after the formation of the electroplating film, and then forming a second sacrificial material pattern on a predetermined portion of the second seed metal film; forming an electroplating film on an exposed portion of the second seed metal film while supplying a current to the second seed metal film; and etching a bottom surface of the substrate by use of the electrolytic polishing process, and then removing the exposed portions of the second sacrificial material pattern, first sacrificial material pattern and second seed metal film, thereby forming an assistant ink supply passage, a micro-chamber and a nozzle.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
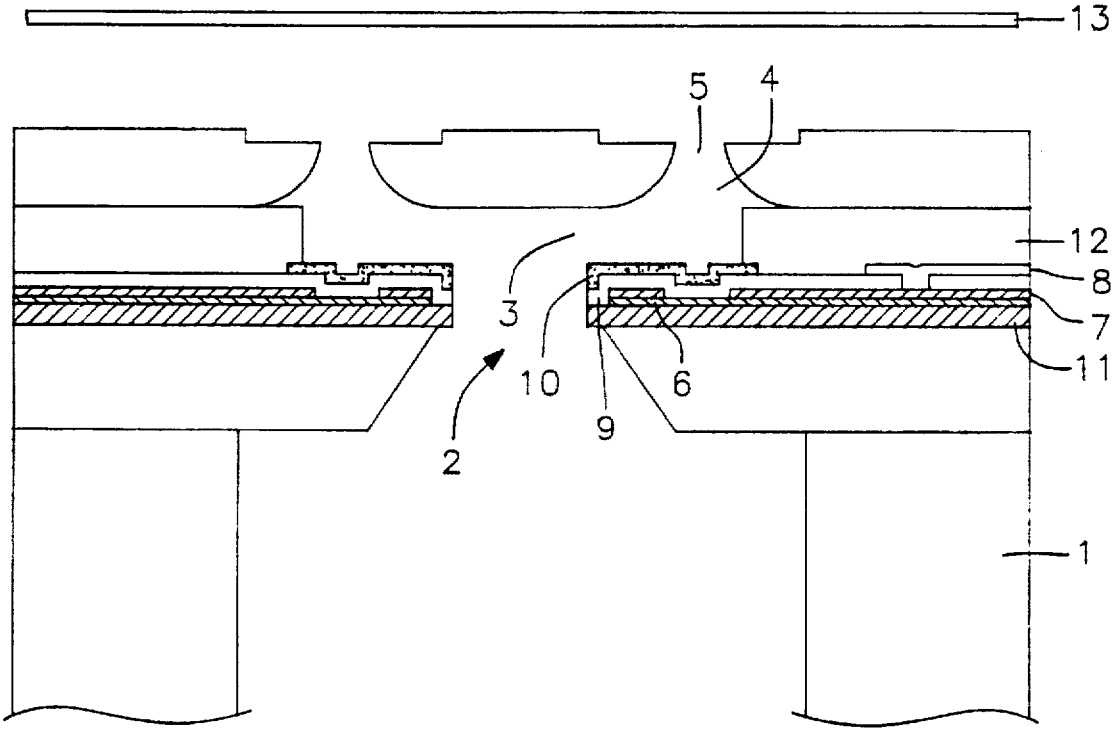
FIG. 1 (PRIOR ART)
FIG. 1 is a sectional view illustrating a conventional heat-generating type ink-jet print head, wherein ink injection is carried out in the upper surface of the head.
Figure 2:
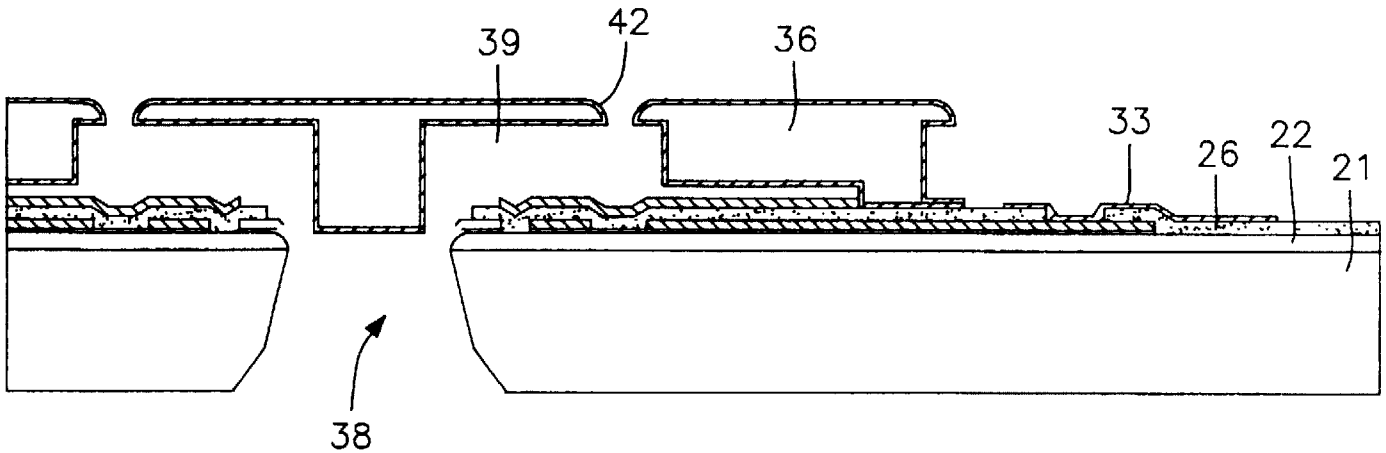
FIG. 2 is a sectional view illustrating a heat-generating type ink-jet print head in accordance with a first embodiment of the present invention.

Referring to FIG. 2, illustrated is an ink-jet print head in accordance with an embodiment of the present invention. As shown in FIG. 2, the ink-jet print head, includes a substrate 21 provided with a main ink supply passage 38 with a cross-section having a wide and gentle lower portion and a narrow and sharp upper portion. On the substrate, a heat-generating resistor film 25 and a wire 26 are formed in a sequential manner. A T-shaped metal structure 36 is fixedly disposed over the substrate 21, such that its lower surface facing the main ink supply passage 38 is flush with the upper surface of the substrate 21. A space is defined between the metal structure 36 and the substrate 21. In the space, an assistant ink supply passage 39 and a micro-chamber 40 (FIG. 4J) are formed. An upwardly-opened nozzle 41 (FIG. 4J) is connected to the micro-chamber 40. An insulating film 30 (FIG. 4D) is also provided to fixedly mount the metal structure 36 to the substrate 21.

The metal structure 36 is plated with a gold film 42. The insulating film 30 is formed on a protection layer adapted to protect the wire 26. The nozzle 41 has a cross-section being gradually widened and more gentle as it extends from the micro-chamber 40 to the outer end of the metal structure 36.

Figure 3:
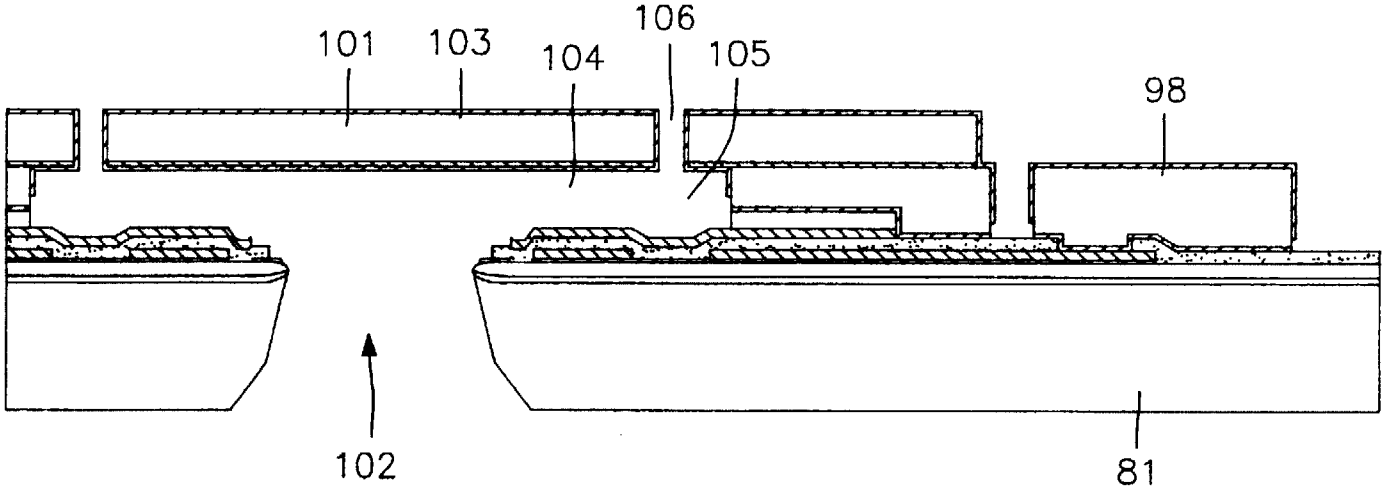
FIG. 3 is a sectional view illustrating a heat generating type ink-jet print head in accordance with a second embodiment of the present invention.

Referring to FIG. 3, illustrated is an ink-jet print head fabricated using the electrolytic polishing process, in accordance with another embodiment of the present invention. As shown in FIG. 3, the ink-jet print head includes a substrate 81 provided with a main ink supply passage 102 having a cross-section with a wide and gentle lower portion and a narrow and sharp upper portion. On the substrate, an impurity diffusion layer 84 (FIG. 7A) doped with phosphorous ions and an insulating film 85 (FIG. 7A) are formed in a sequential manner. On the insulating film 85, a heat-generating resistor film 88 (FIG. 7C) and a wire 89 (FIG. 7C) are formed in a sequential manner. A metal structure 98 is fixedly mounted on the substrate 21 by means of the insulating film 85. The metal structure 98 is electrically connected to a grounding wire. Another metal structure 98 is disposed adjacent to the metal structure 98. The metal structure 98 extends in parallel to the substrate 81, such that it defines an assistant ink supply passage 104 and a micro-chamber 105 above the main ink supply passage 102 inside side of the main ink supply passage 102. A nozzle 106 is connected to the micro-chamber 105. The nozzle 106 extends throughout the metal structure 101.

The metal structures 98 and 101 are plated with a gold film 103 so that it is stable. The insulating film 85 is formed on a protection layer adapted to protect the wire 89.

Next, a method for fabricating the ink-jet print head having the structure, in accordance with the first embodiment of the present invention, will be described in conjunction with FIGS. 4A to 4K.

In accordance with this method, first, a non-conductive insulating film 22, such as silicon oxide film, silicon nitride film or silicon carbide film, is formed over a p type silicon substrate 21. The insulating film 22 is locally etched to form a window 23. The window 23 corresponds to the region where a main ink supply passage will be formed.

Figure 4A:
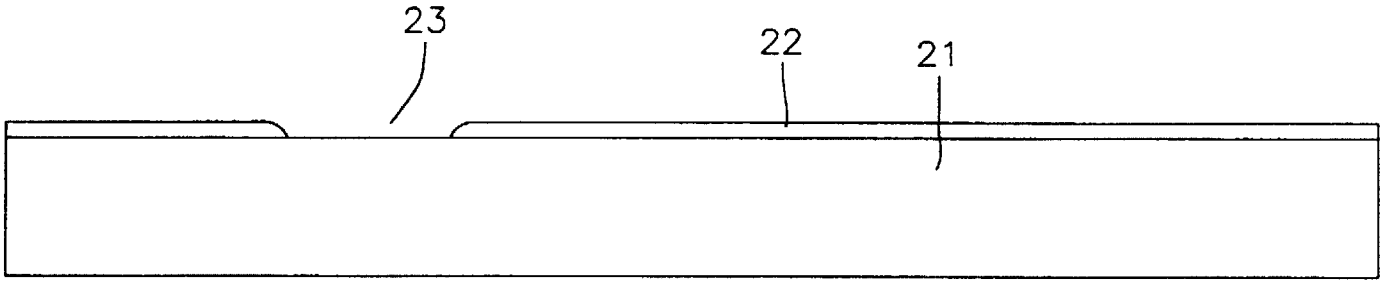
FIGS. 4A to 4K are sectional views respectively illustrating a method for fabricating the ink-jet print head shown in FIG. 2.
Figure 4B:
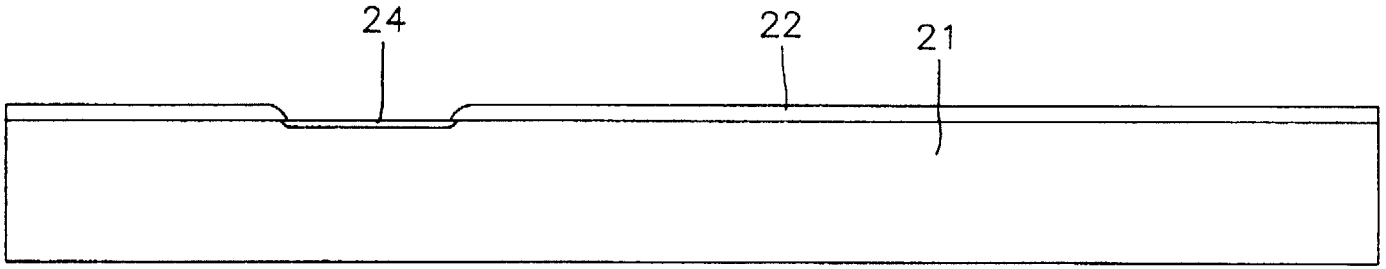

Thereafter, boron ions are implanted in an exposed portion of the substrate 21 through the window 23, thereby forming a boron-doped layer 24, as shown in FIG. 4B. The boron-doped layer 24 will serve to improve the electrical contact characteristic obtained between the substrate and the metal film to be subsequently formed. The formation of the insulating film 22 is achieved by forming a thermal oxidation film over the p type silicon substrate having <100> orientation to a thickness of 1 μm. The boron-doped layer 24 has a boron ion concentration of $10^{18}/cm^3$ or above and is formed using a thermal diffusion process. The window 23 has a size of 500 μm×3,500 μm.

Figure 4C:
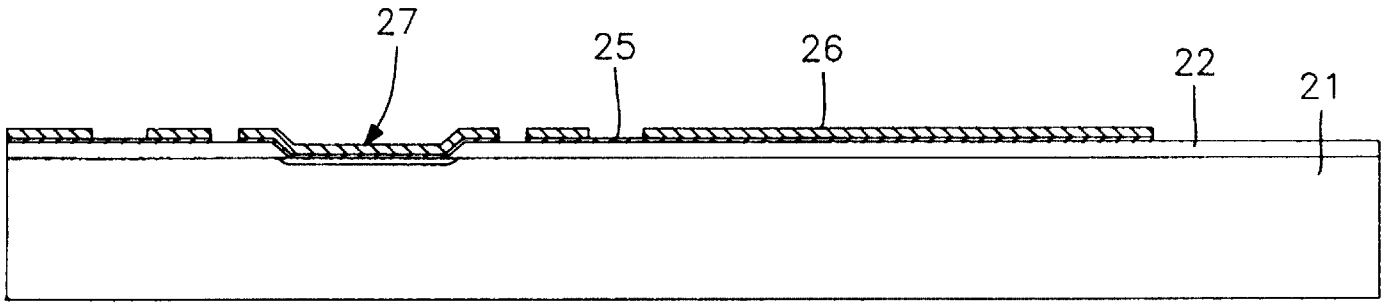

Over the resulting structure, a tantalum-aluminum (TaAl) film having a thickness of 0.1 μm and an aluminum film having a thickness of 0.5 μm are then sequentially formed, as shown in FIG. 4C. The tantalum/aluminum film and the aluminum film are then patterned to form a heat-generating resistor film 25 and a metal wire 26, respectively. The heat-generating resistor film 25 may be made of tantalum or chromium. The metal wire 26 may be made of copper or gold. Upon patterning the tantalum/aluminum film and the aluminum film, a composite layer 27 constituted by the films is also formed. The composite layer 27 covers the window 23 where the boron-doped layer 24 is formed. The composite layer 27 is electrically connected to the substrate 21 via the boron-doped layer 24.

Figure 5A:
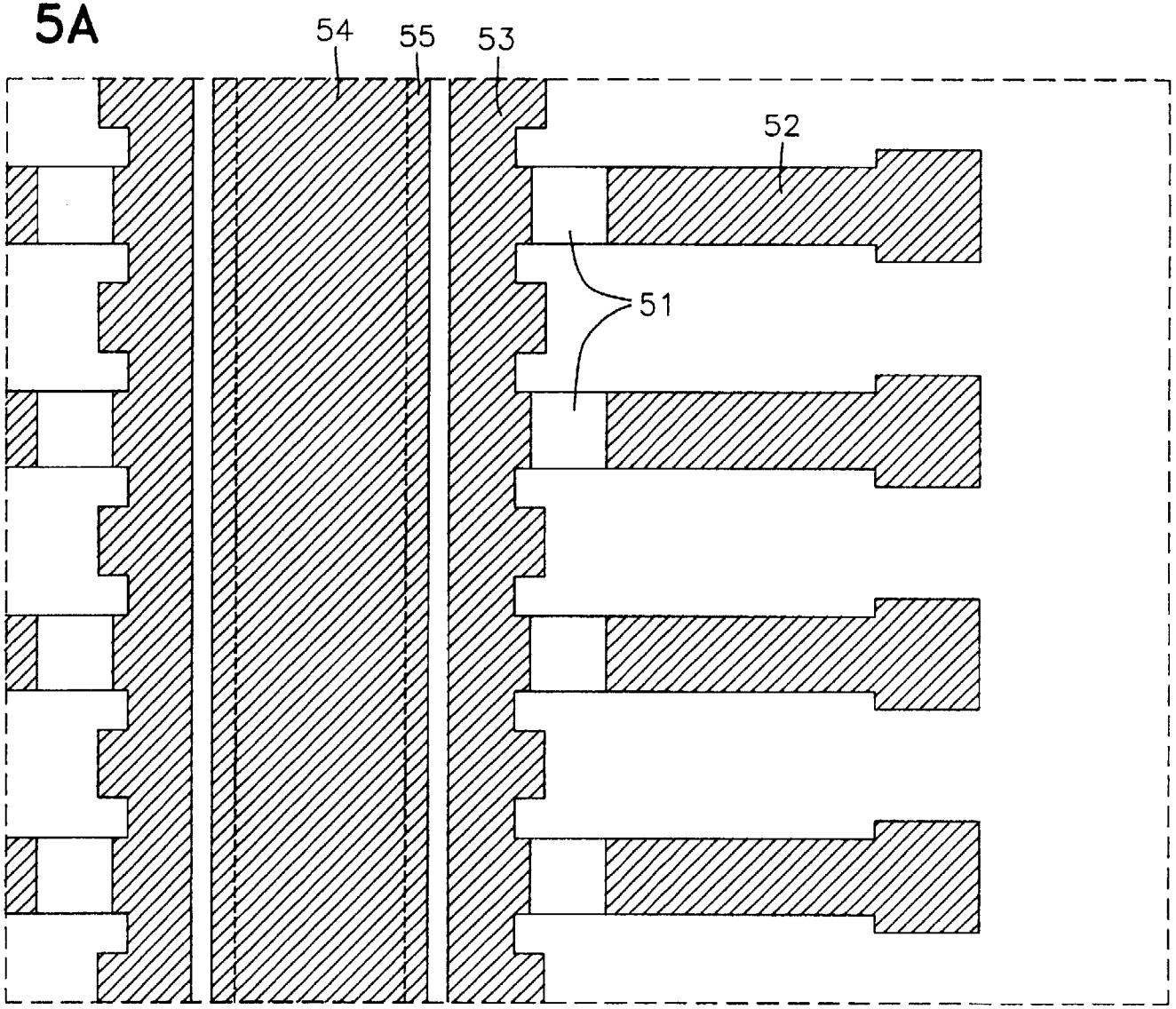
FIGS. 5A to 5D are plan views respectively illustrating the method of FIGS. 4A to 4K.

FIG. 5A is a plan view illustrating the substrate formed with the resistor and the metal wiring. As shown in FIG. 5A, a plurality of heat-generating resistor films 51 are connected to independent wires 52 respectively and to a common grounding wire 53. By referring to FIG. 5A, it can be found that a composite layer 54 (it corresponds to the composite layer 27 of FIG. 4C) of tantalum/aluminum and aluminum is isolated from the heat-generating resistor films 51 and the grounding wire 53 and covers a window 55 formed by locally etching an insulating film.

Figure 4D:
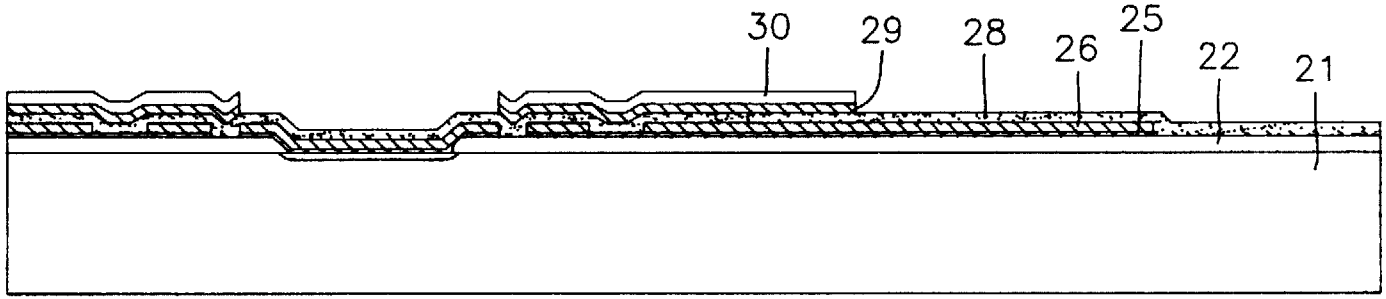
Figure 4E:
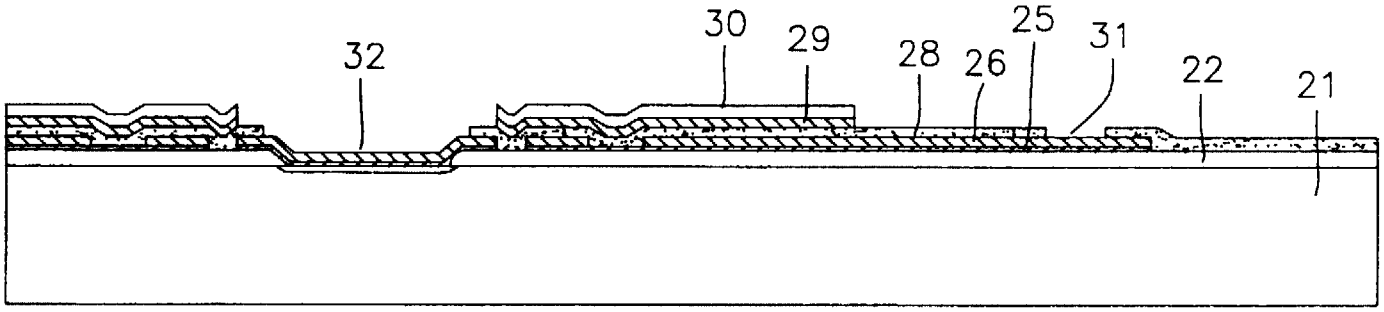
Figure 4F:
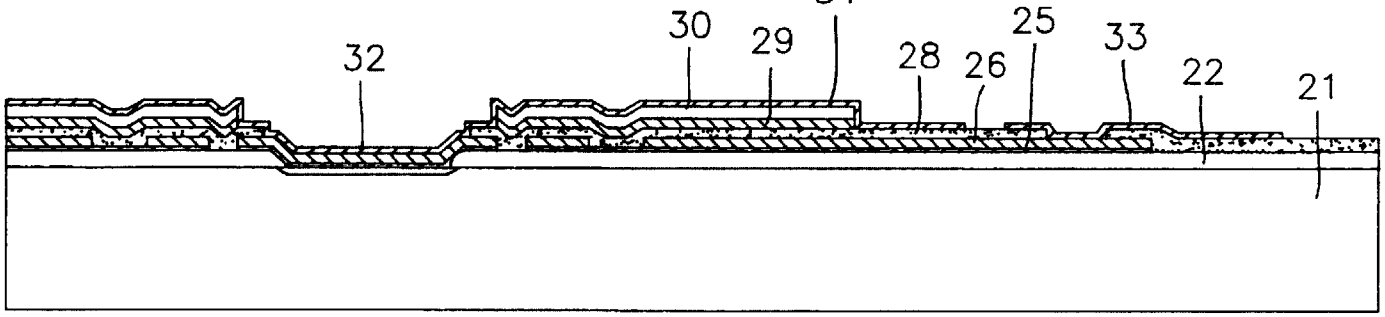

Over the resulting structure, a protection film 28 and a metal protection film 29 are then formed in a sequential manner, as shown in FIG. 4D. The protection film 28 is comprised of one selected from a group consisting of a silicon oxide film, a silicon nitride film, a silicon carbide film and a composite layer thereof. On the other hand, the metal protection film 29 is made of tantalum or chromium. Thereafter, an insulating film 30 made of a non-conductive material is formed over the metal protection film 29. The insulating film 30 and the protection film 29 are then patterned to partially cover the heat-generating resistor film 25, the grounding wire and the independent wire.

In accordance with the present invention, the protection film 28 is comprised of a composite layer constituted by a silicon nitride film having a thickness of 0.6 μm and a silicon carbide film having a thickness of 0.3 μm. The silicon nitride film and silicon carbide film are deposited using the plasma-enhanced chemical vapor deposition (PECVD) process. The protection film 29 is comprised of a tantalum film deposited to a thickness of 0.6 μm using a sputtering process. On the other hand, the insulating film 30 is comprised of a silicon oxide film deposited to a thickness of 1 μm using the PECVD process. The insulating film 30 may be comprised of one selected from a group consisting of a silicon oxide film, a silicon nitride film, a silicon carbide film and a composite layer thereof.

Subsequently, the protection film 28 is etched at its portion corresponding to the region where the main ink supply passage will be formed, thereby forming a window 31. At this time, a window 32 is also formed by etching a predetermined portion of the protection film 28. Through the windows 31 and 32, the wiring is partially exposed.

Over the resulting structure, a seed metal film 34 is then deposited, as shown in FIG. 4. The seed metal film 34 is comprised of a composite layer of titanium and gold or a chromium layer. In the illustrated case, the seed metal film 34 a composite layer constituted by a titanium layer having a thickness of 0.05 μm and a gold layer having a thickness of 0.2 μm. AS shown in FIG. 5B, the seed metal film forms pads 56 electrically connected to a wire 57 over a window formed at the wiring. Accordingly, the seed metal film 34 covers the region where the main ink supply passage will be formed and is electrically connected with the composite layer of tantalum/aluminum and aluminum formed at the main ink supply passage region while being electrically isolated from the wiring and heat-generating resistor film by the protection film.

Figure 4G:
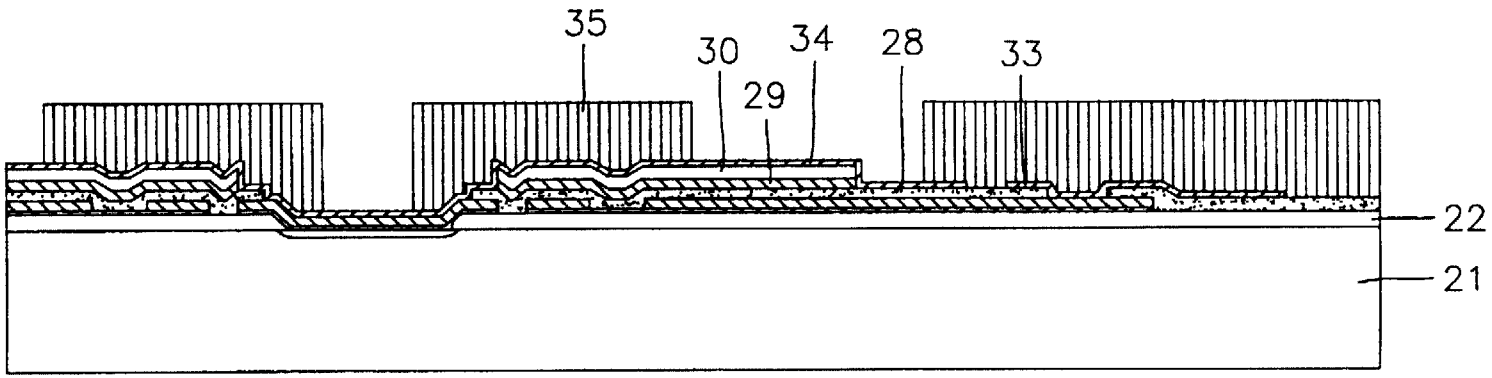
Figure 5B:
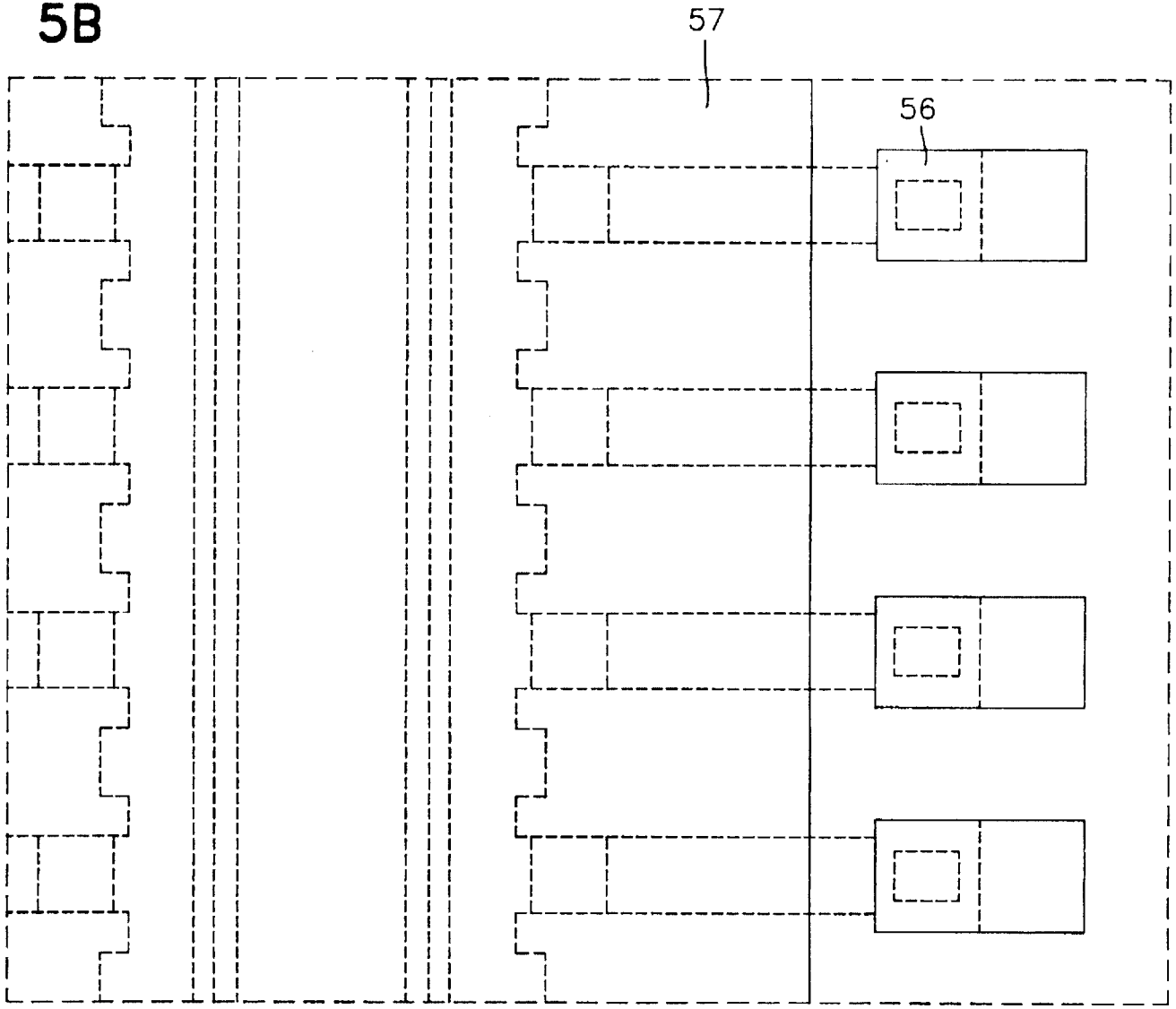
Figure 5C:
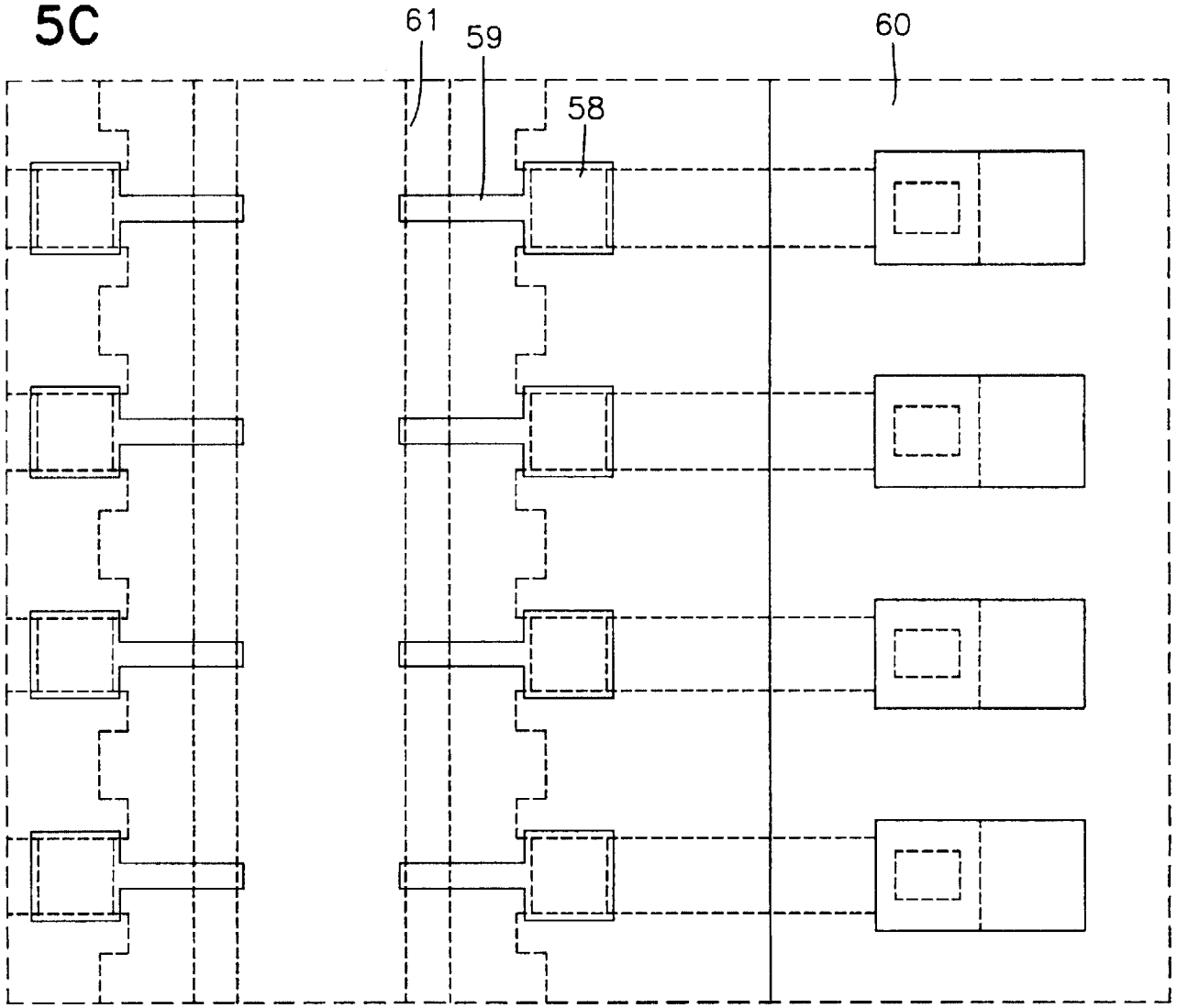

A sacrificial material pattern 35 is then formed on the seed metal film 34, as shown in FIG. 4G. As shown in FIG. 5C, the sacrificial material pattern 35 includes a planar square pattern 58 and a rectangular pattern 59 connected at its one side to one side of the square pattern 58. The length of the side of rectangular pattern 59, connected to the square pattern 58, is smaller than that of the square pattern 58. The end of rectangular pattern 59, spaced away from the square pattern 58, overlaps with the region 61 where the main ink supply passage will be formed. In the above illustrated case, the sacrificial material pattern 35 is comprised of a photoresist film or polymer film having a thickness of 25 μm.

Figure 4H:
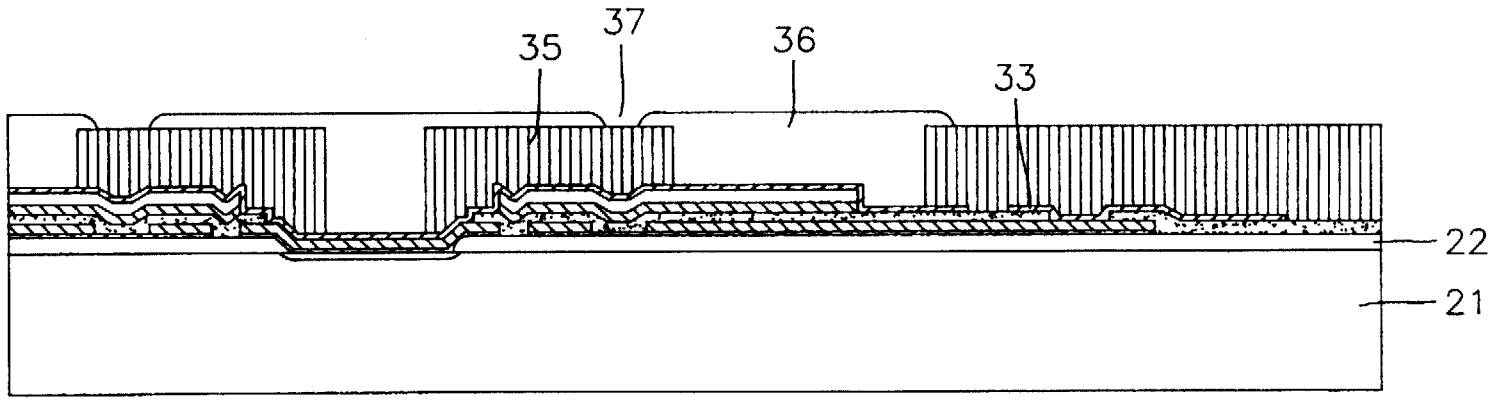
Figure 5D:
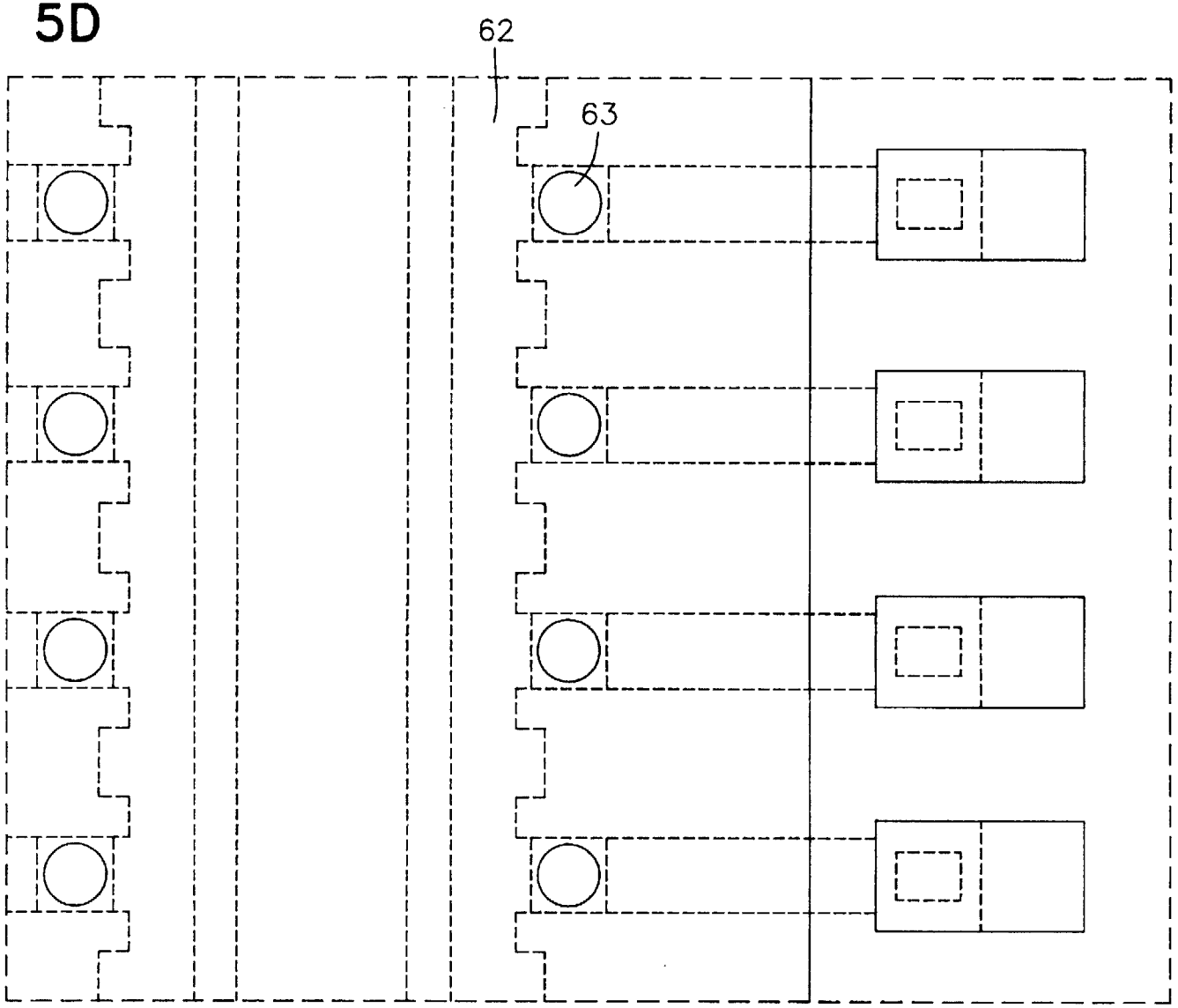

Thereafter, an electroplating is carried out by supplying a current to the seed metal film 34 to form a copper or nickel plating film 36 on the sacrificial material pattern 35 to a predetermined thickness, as shown in FIG. 4H. The plating film 36 covers the sacrificial material pattern 35 except for a predetermined portion of the rectangular pattern. Accordingly, a plating film window 37 is formed. FIG. 5D, which is a plan view corresponding to FIG. 4H, shows the plating film and the window respectively denoted by the reference numerals 62 and 63. In the above illustrated case, nickel is electroplated.

The resulting structure obtained after completing the above processing steps is then subjected to the electrolytic polishing step. In the electrolytic polishing step, the main ink supply passage, denoted by the reference numeral 38, is formed, such that it extends vertically throughout the substrate 21 at the region where the window is formed. This electrolytic polishing step will now be described in detail in conjunction with FIG. 6.

Figure 6:
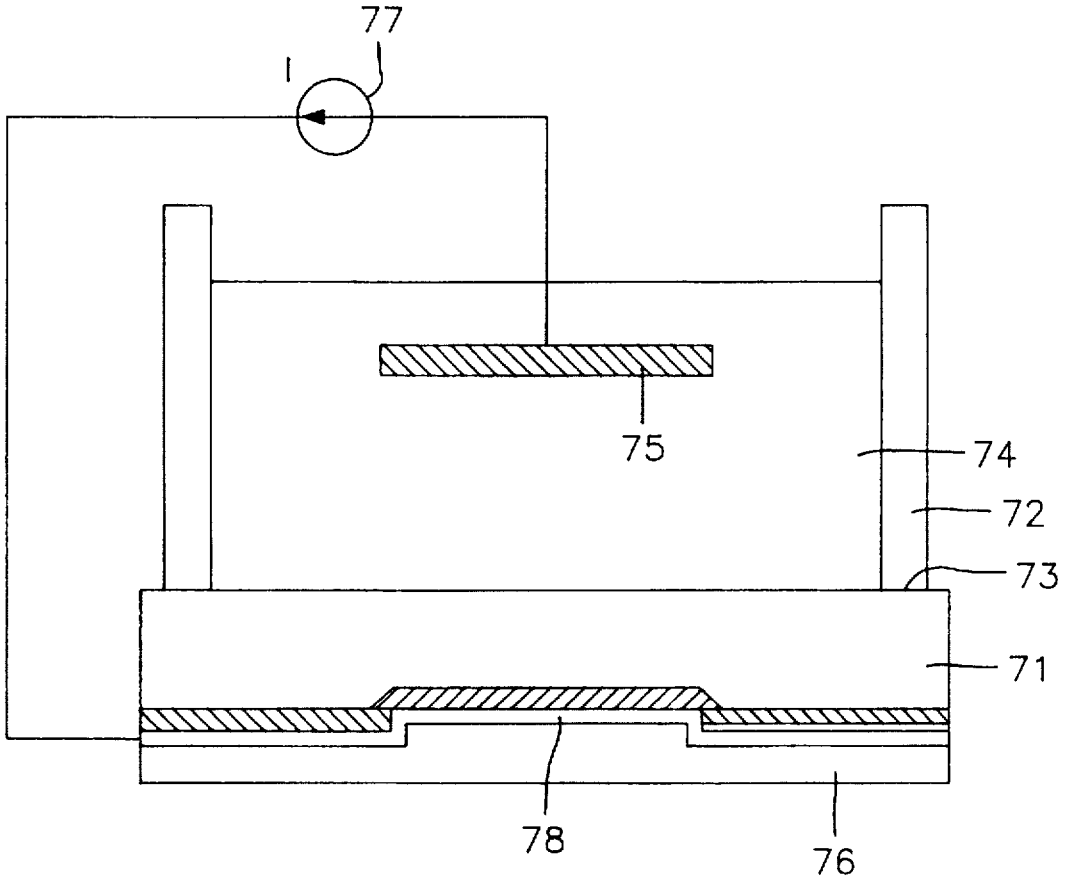
FIG. 6 is a schematic view illustrating an electrolytic polishing device used to carry out the electrolytic polishing process which is applied to the present invention.

FIG. 6 is a schematic view illustrating an electrolytic polishing device.

For carrying out the electrolytic polishing step, first, the bottom surface of the structure obtained after completing the step of FIG. 4H comes into close contact with the bottom surface of a Teflon container 72. In FIG. 6, the structure is denoted by reference numeral 71. Thereafter, the structure 71 and Teflon container 72 are sealed by an O-ring 73. Subsequently, the Teflon container 72 is filled with a 16 wt % fluoric acid solution, a solution containing a 24 wt % fluoric acid and a 70 wt % nitric acid in a ratio of 2:1, or a solution containing a fluoric acid, a nitric acid and an acetic acid. The solution filling the Teflon container 72 is denoted by reference numeral 74. A platinum electrode 75 is then dipped in the solution 74. Thereafter, the platinum electrode 75 and the seed metal film or electroplating film 76, formed on the top surface of the structure 71, are connected to the static current source 77.

Figure 4I:
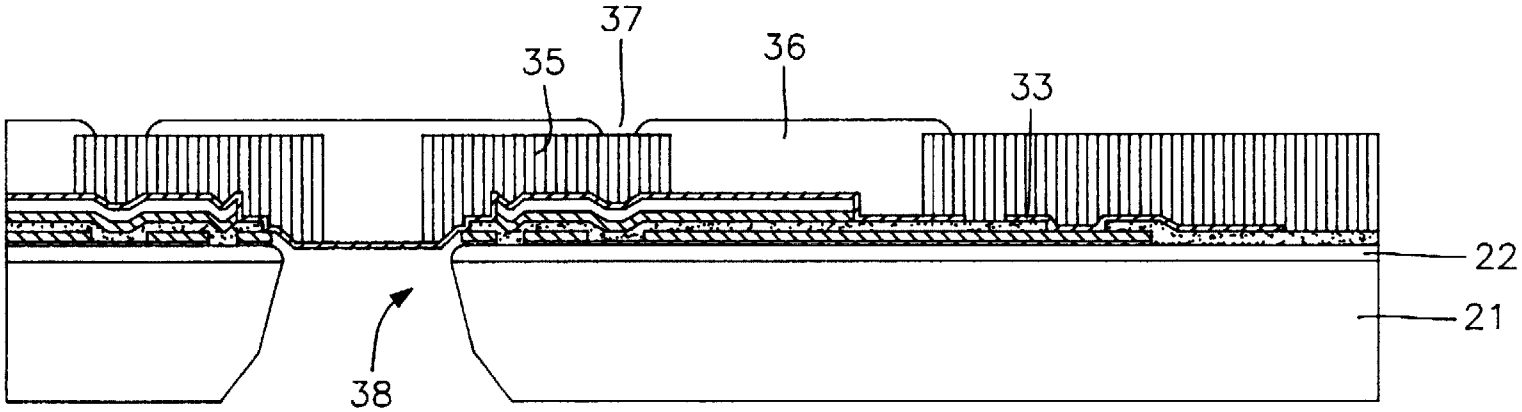

As an appropriate current is supplied, such that the seed metal film or electroplating film of the structure 71 acts as an anode while the platinum electrode dipped in the solution acts as a cathode, the silicon substrate of the structure 71 has begun to be etched at its bottom surface being in contact with the solution. Since the current is supplied through the insulating film window 78, the portion of substrate disposed near the window has a larger current density that those of other portions. As a result, the portion of substrate disposed near the window is etched at a higher rate, as compared to other portions of substrate. By virtue of such different etch rates, the main ink supply passage is formed at the region where the insulating film window is formed. The main ink supply passage formed in such a manner has a cross-section having a wide and gentle lower portion and a narrow and sharp upper portion, as shown in FIG. 4I.

Figure 4J:
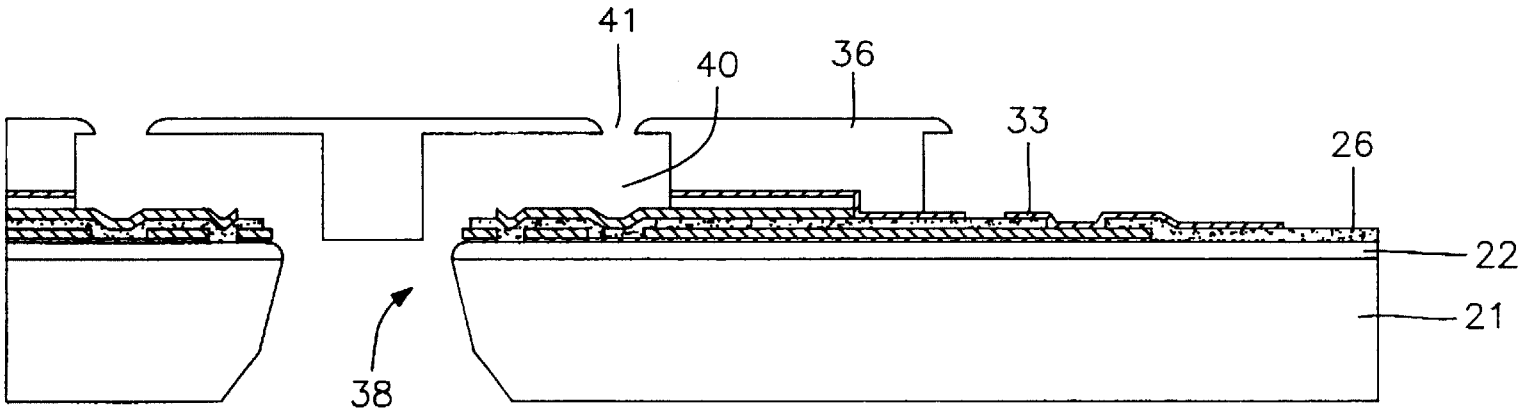

After completing the above electrolytic polishing step, the sacrificial material pattern is removed from the structure. As a result, the structure is formed with an assistant ink supply passage 39, a micro-chamber 40 and a nozzle 41, as shown in FIG. 4J. Thereafter, portions of the seed metal film 34 and insulating film 30 disposed in the micro-chamber 40 are then removed. As a result, a micro ink supply structure extending from the main ink supply passage to the nozzle via the assistant ink supply passage and the micro-chamber is obtained.

Figure 4K:
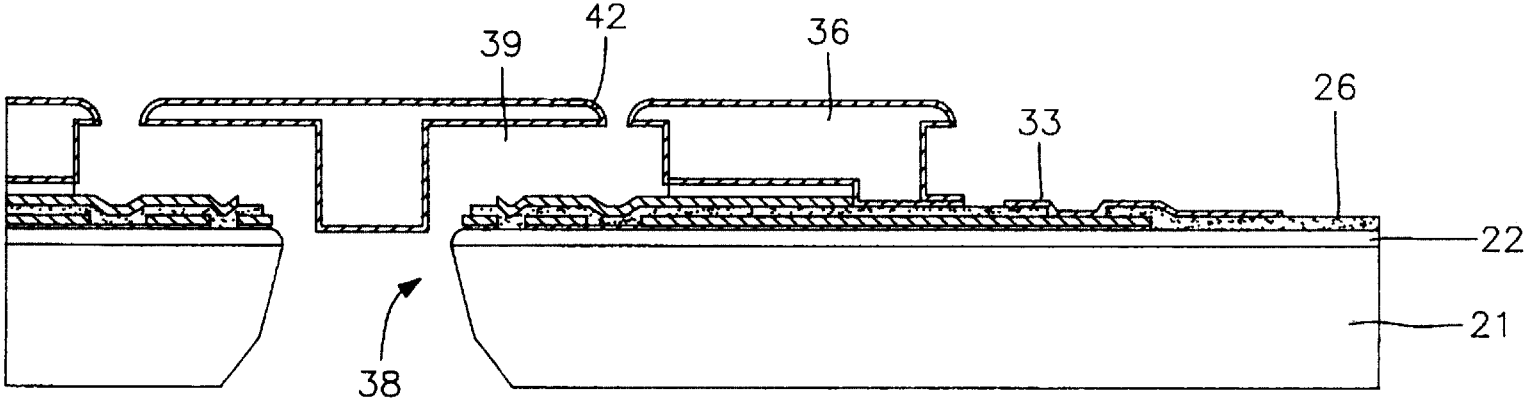

Finally, a gold plating film 42 is formed over the electroplating film 36 so as to protect the electroplating film 36 from erosion by the ink, as shown in FIG. 4k. Thus, a heat-generating type ink-jet print head is obtained.

Now, a method for fabricating the ink-jet print head having the structure in accordance with the second embodiment of the present invention will be described in conjunction with FIGS. 7A to 7L.

Figure 7A:
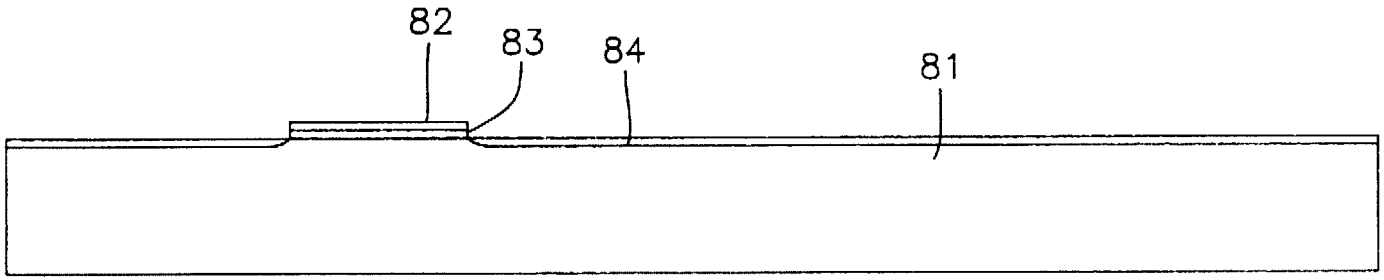
FIGS. 7A to 7L are sectional views respectively illustrating a method for fabricating the ink-jet print head shown in FIG. 3.

In accordance with this method, first, a silicon nitride film pattern 82 is formed on a portion of a p type silicon substrate 81 corresponding to a region where a main ink supply passage will be formed, as shown in FIG. 7A. An n type film 84 is also formed on the other portion of the silicon substrate 81. The formation of the silicon nitride film pattern 82 is achieved by forming a thermal oxidation film as a buffer film 83 on the p type silicon substrate having <100> orientation to a thickness of 0.05 μm and then forming a silicon nitride film over the buffer film 83 to a thickness of 0.2 μm. The n type film 24 is formed by thermally diffusing phosphorous ions having a concentration of $10^{18}/cm^3$ or below.

The resulting structure obtained after completing the step in FIG. 7A is then subjected to a thermal oxidation. By the thermal oxidation, the silicon portion of the structure is oxidized. At this time, the silicon nitride film pattern 82 is not oxidized. As a result, an insulating film 85 constituted by the thermal oxidation film is formed. Thereafter, the silicon nitride film pattern 82 is removed, thereby forming a window 86 at the region where the main ink supply passage will be formed. The window 86 is surrounded by the insulating film 85.

Figure 7B:
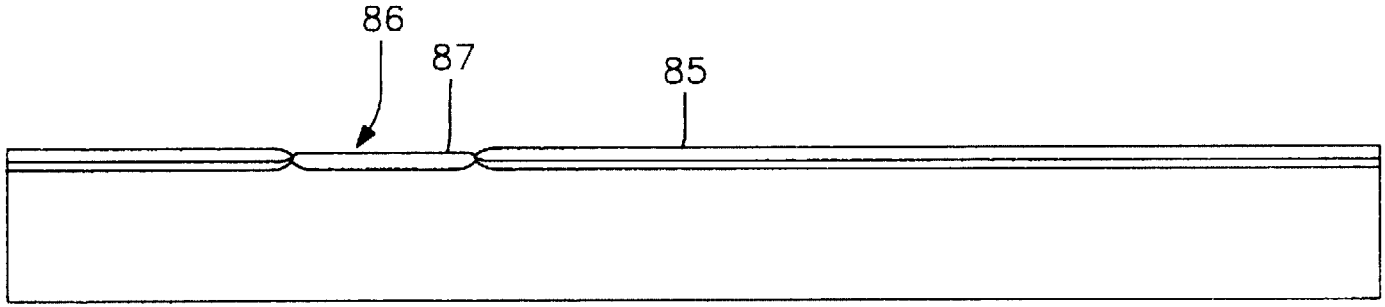

Thereafter, boron ions are implanted in a concentration of $10^{18}/cm^3$ or above in an exposed portion of the substrate 81 through the window 86, thereby forming a boron-doped layer 87, as shown in FIG. 7B. The boron-doped layer 87 will serve to improve the electrical contact characteristic obtained between the substrate and a metal film to be subsequently formed. In the illustrated case, the thermal oxidation film 85 has a thickness of 1 μm. The boron-doped layer 87 is formed using the thermal diffusion process. The window 86 has a size of 500 μm×3,500 μm.

Figure 7C:
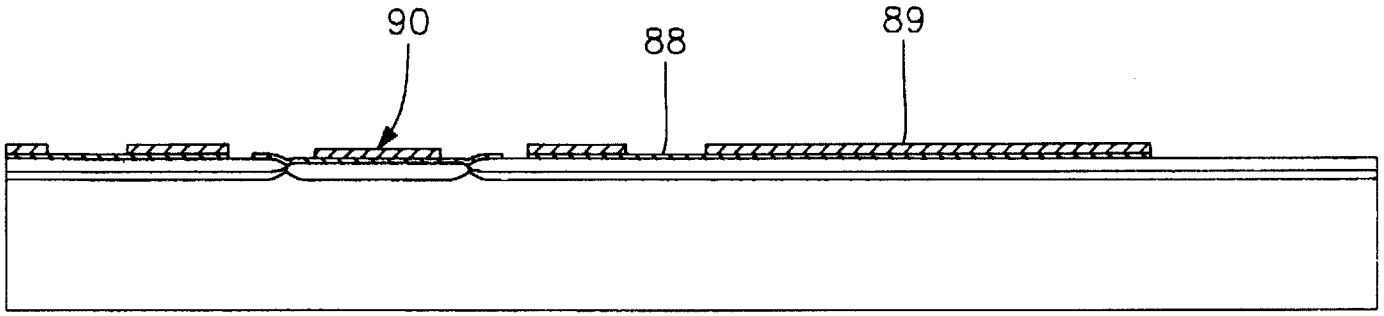
Figure 8A:
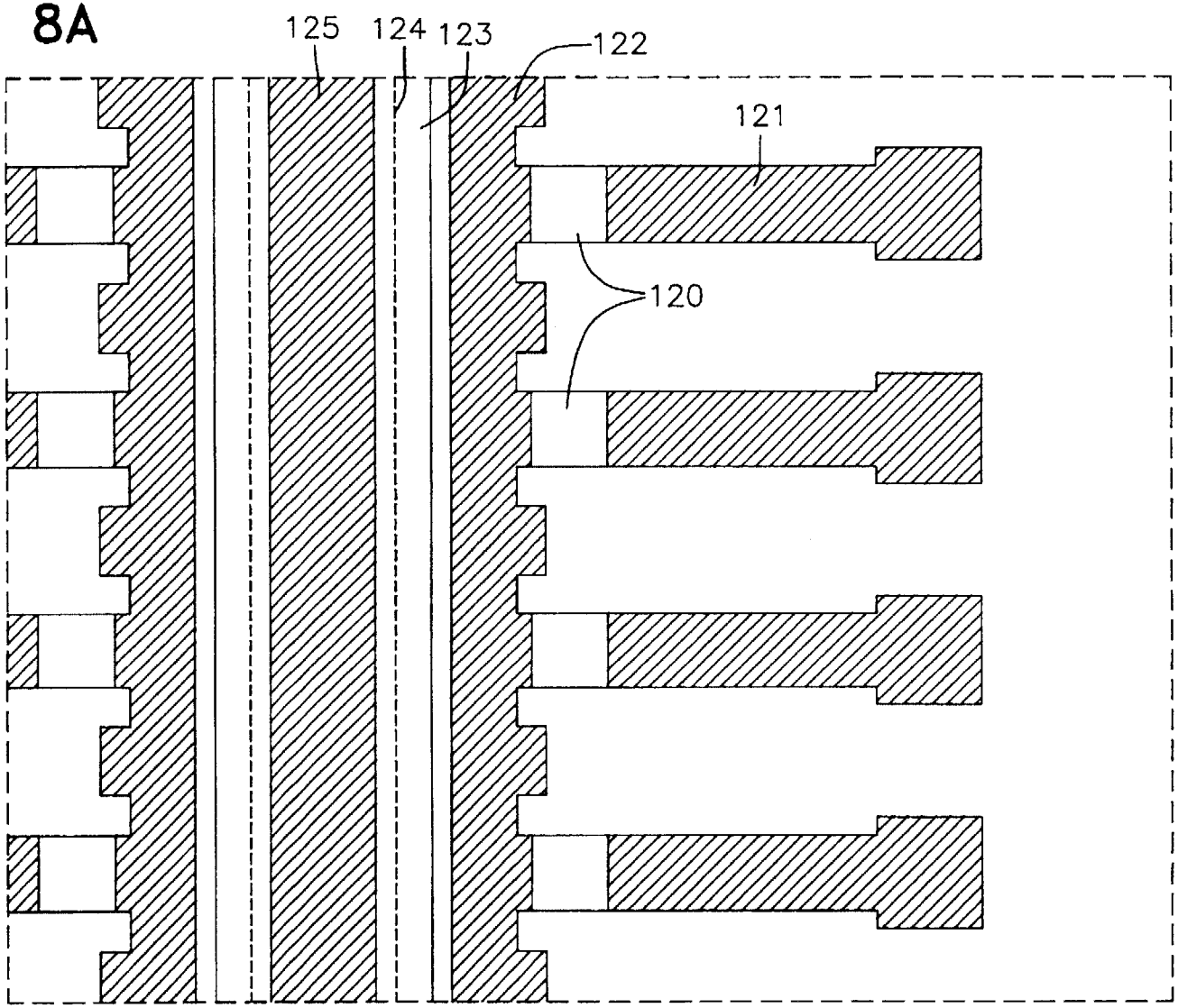
FIGS. 8A to 8E are plan views respectively illustrating the method of FIGS. 7A to 7L.

Over the resulting structure, a tantalum-aluminum film having a thickness of 0.1 μm and an aluminum film having a thickness of 0.5 μm are then sequentially formed, as shown in FIG. 7C. The tantalum/aluminum film and the aluminum film are then patterned to form a heat-generating resistor film 88 and a metal wire 89, respectively. Upon patterning the tantalum/aluminum film and the aluminum film, a composite layer 90 constituted by the films is also formed. The composite layer 90 covers the window 86 where the boron-doped layer 87 is formed. The composite layer 90 is electrically connected to the substrate 81 via the boron-doped layer 87. FIG. 8A is a plan view illustrating the substrate formed with the resistor and the metal wiring. As shown in FIG. 8A, a plurality of heat-generating resistor films 120 are connected to independent wires 121 respectively and to a common grounding wire 122. By referring to FIG. 5A, it can be found that a tantalum/aluminum pattern 123 is isolated from the heat-generating resistor films 120 and the grounding wire 121 and covers a window 124 formed by locally etching an insulating film.

Figure 7D:
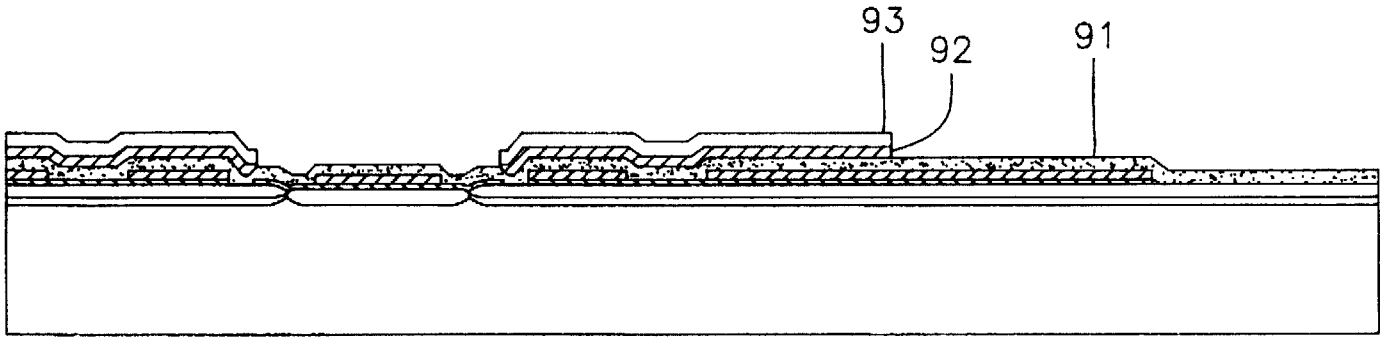
Figure 8B:
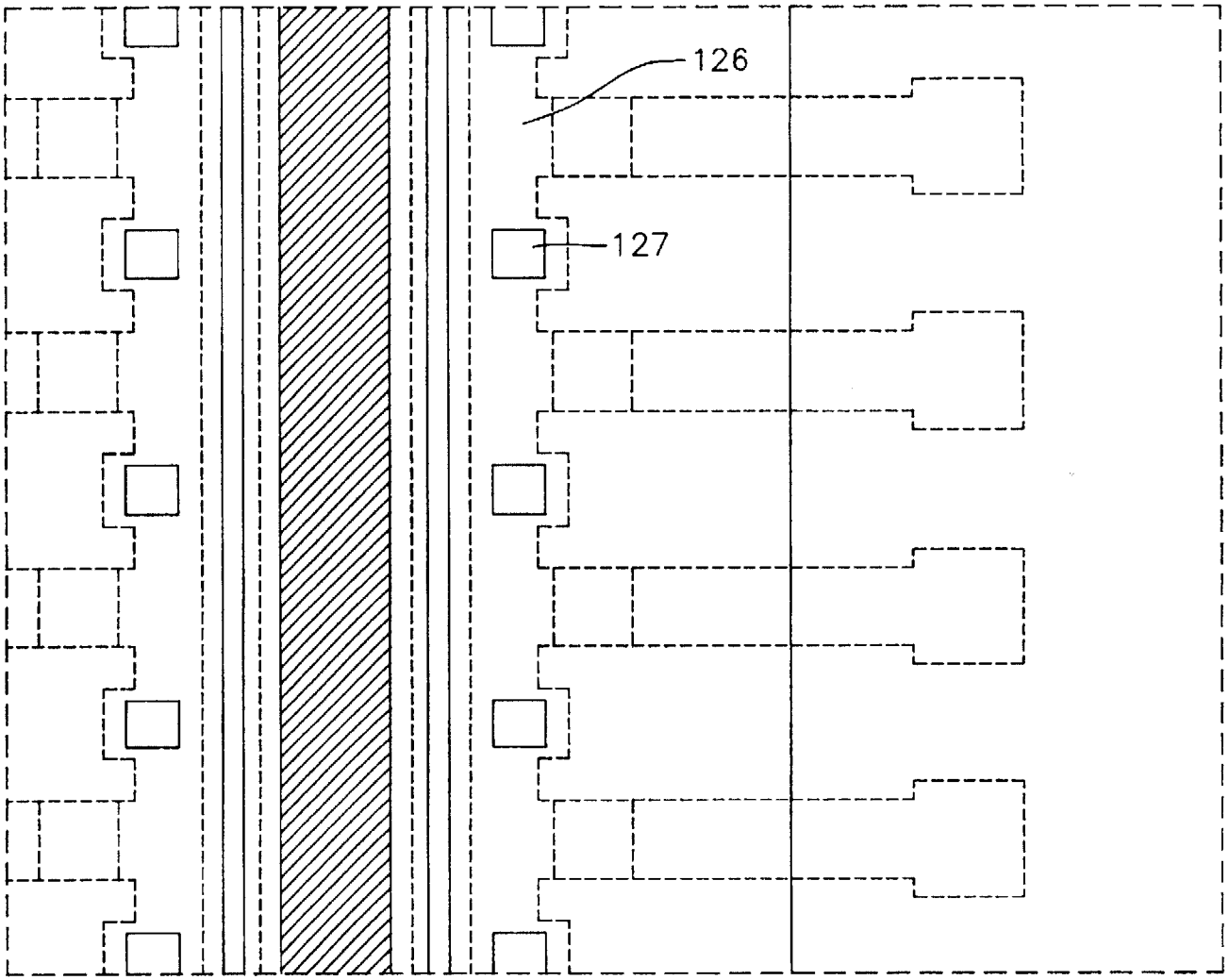

Over the resulting structure, a non-conductive protection film 91, a metal protection film 92 and a non-conductive insulating film 93 are then formed in a sequential manner. These films are then patterned such that they cover partially the heat-generating resistor film, grounding wire and independent wires, as shown in FIG. 7D. This pattern has a ring shape surrounding the main ink supply passage when viewed in the plan view of FIG. 8B. As shown in FIG. 8B, the pattern includes windows 127 arranged at a region 126 where the grounding wiring is formed. In accordance with the present invention, the protection film 91 is comprised of a composite layer constituted by a silicon nitride film having a thickness of 0.6 μm and a silicon carbide film having a thickness of 0.3 μm. The silicon nitride film and silicon carbide film are deposited using the PECVD process. The protection film 92 is comprised of a tantalum film deposited to a thickness of 0.6 μm using the sputtering process. On the other hand, the insulating film 93 is comprised of a silicon oxide film deposited to a thickness of 1 μm using the PECVD process.

Figure 7E:
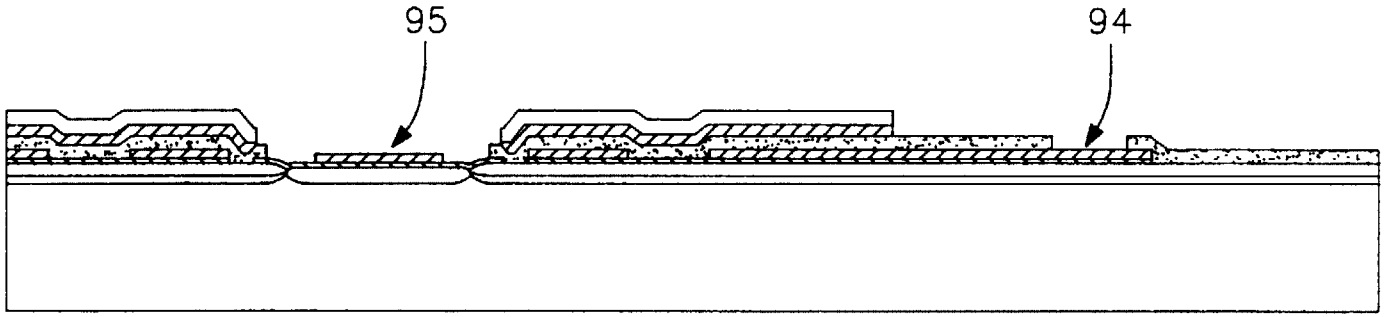

Subsequently, the protection film 92 and protection film 91 are etched at their predetermined portions respectively corresponding to predetermined regions of the independent wires, predetermined regions of the grounding wire and the region where the main ink supply passage will be formed, thereby forming windows 94 and 95 through which the wiring metal film is partially exposed, as shown in FIG. 7E.

Figure 8C:
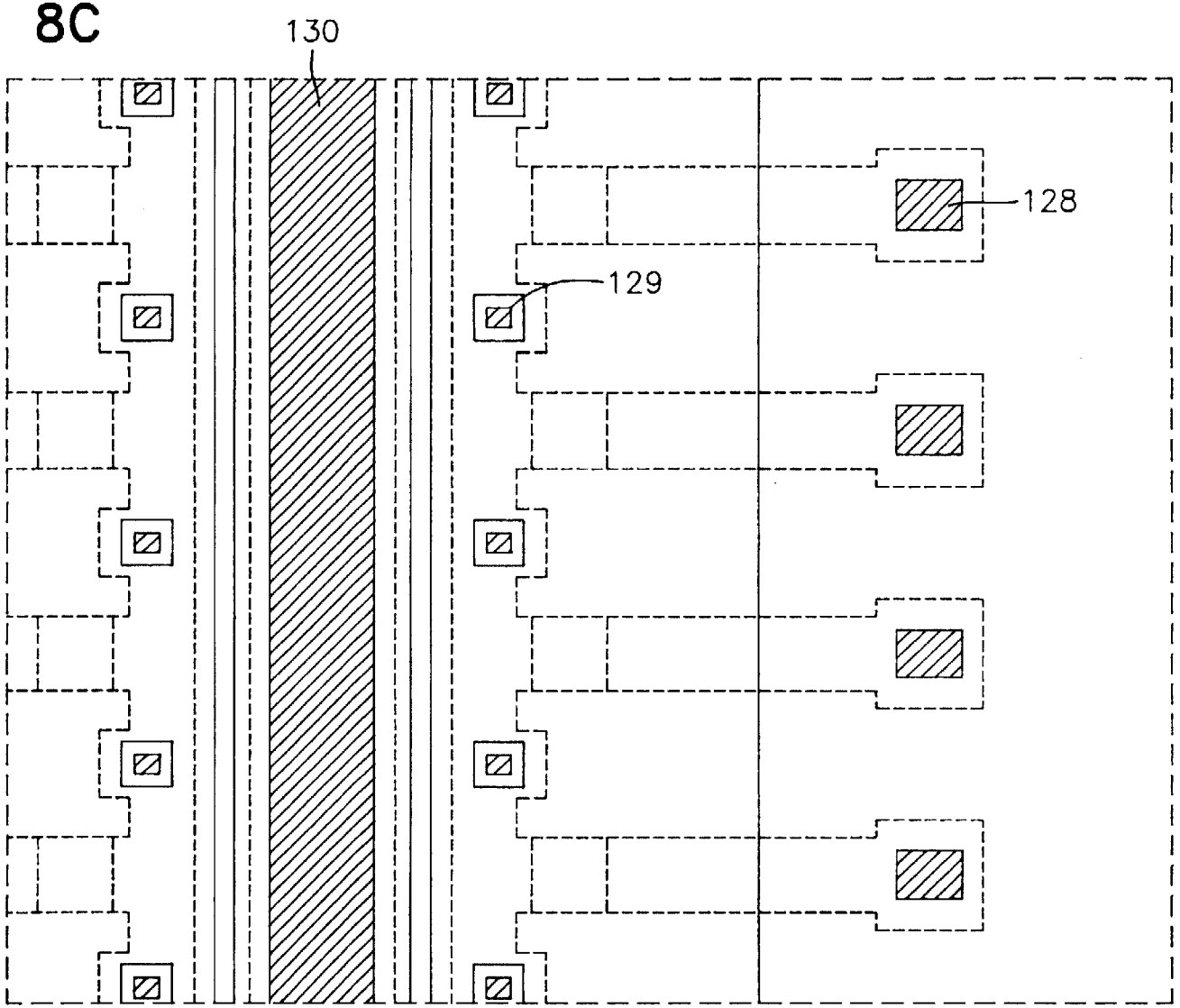

FIG. 8C shows planar shapes of protection film windows 128, 129 and 130.

Figure 7F:
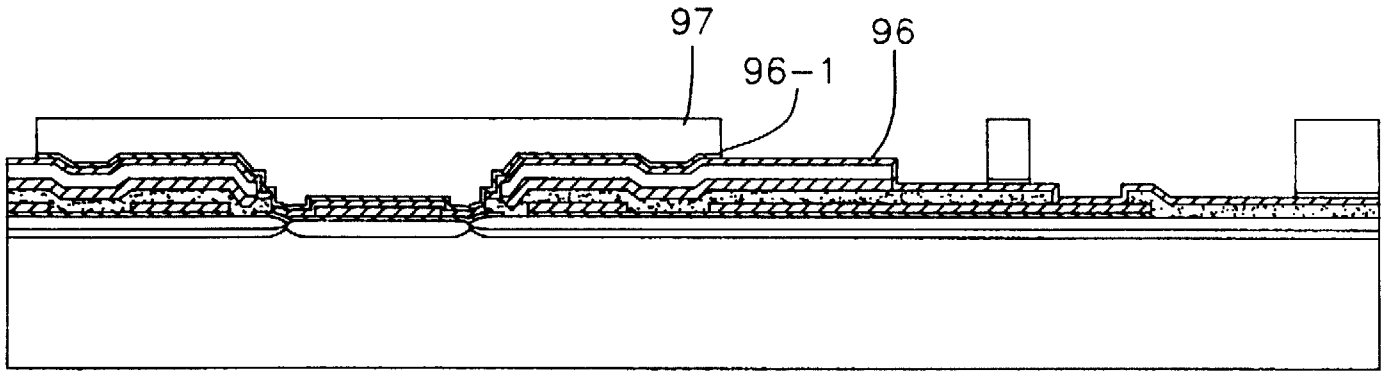
Figure 8D:
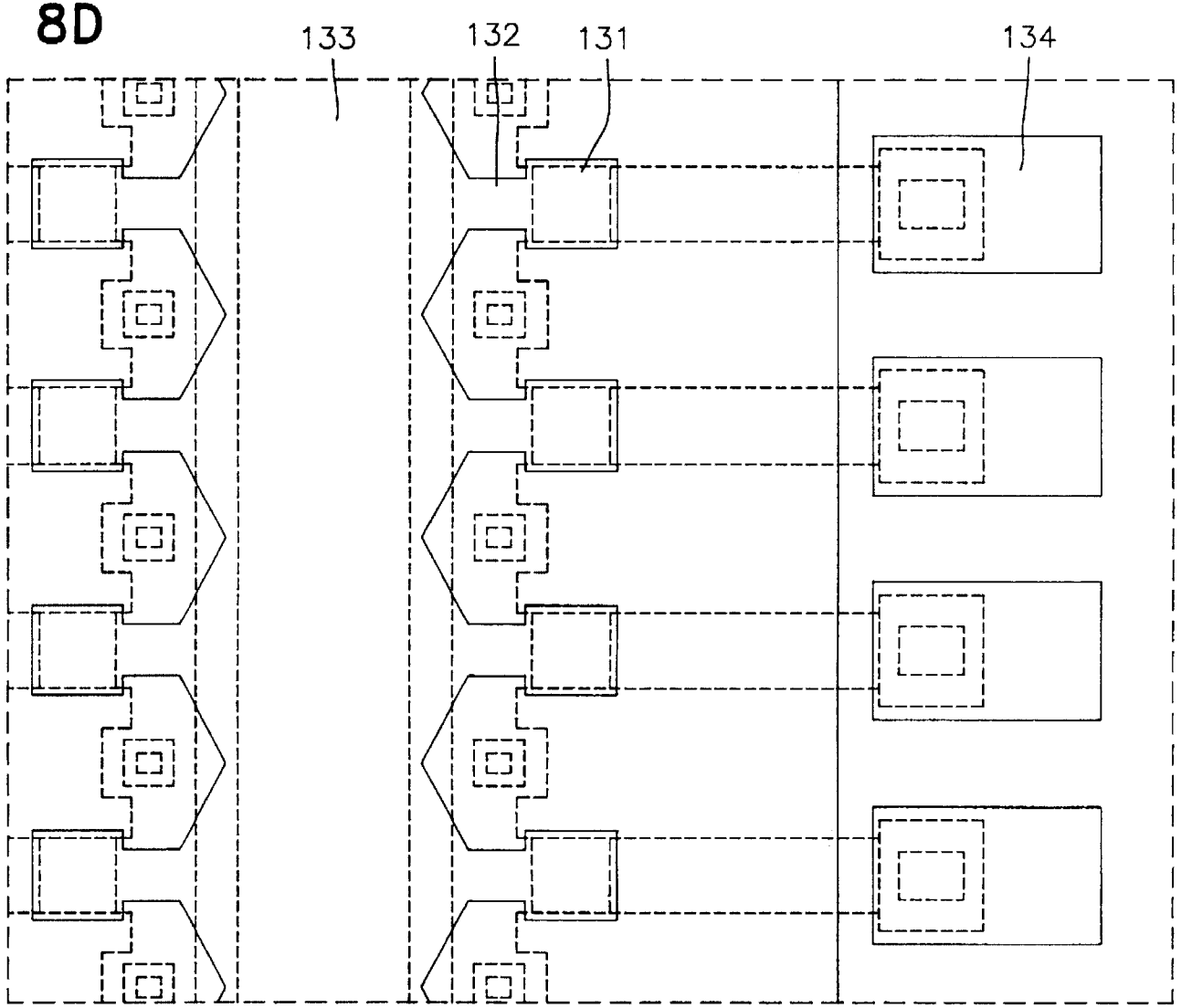

Over the resulting structure, a first seed metal film 96 is then deposited, as shown in FIG. 7F. The seed metal film 96 is comprised of a chromium layer having a thickness of 0.2 μm. An insulating film 96-1 is then formed on a predetermined portion of the first seed metal film 96. The insulating film 96-1 is comprised of a glass film having a thickness of 0.2 μm. The first seed metal film 96 is electrically connected with the portion of wiring metal film exposed through each protection film window. A sacrificial material pattern 97 is then formed over the insulating film 96-1. As shown in FIG. 8D, the sacrificial material pattern 97, which includes a planar square pattern 131 and a rectangular pattern 132 connected at its one side to one side of the square pattern 131. The length of the side of rectangular pattern 132 connected to the square pattern 131 is smaller than that of the square pattern 131. The end of rectangular pattern 132 spaced away from the square pattern 131 overlaps with a pattern 133 where the main ink supply passage will be formed. The sacrificial material pattern 97 defines windows 134 including the protection film windows respectively formed at the independent wires. In the above illustrated case, the sacrificial material pattern 97 is comprised of a photoresist film having a thickness of 25 μm.

Figure 7G:
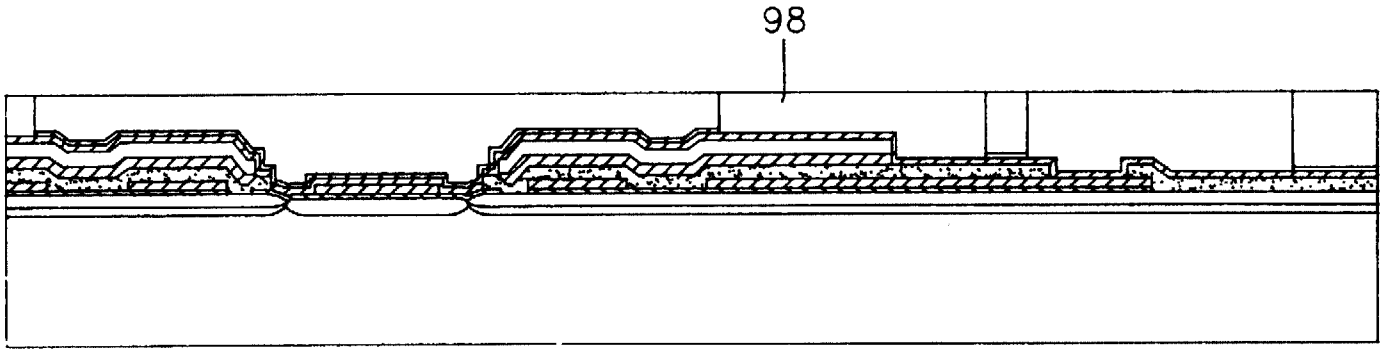

Thereafter, an electroplating film 98 is formed over the exposed portion of the seed metal film 96 to a thickness corresponding to that of the sacrificial material pattern 97 by supplying a current to the seed metal film 96, as shown in FIG. 7G.

Figure 7H:
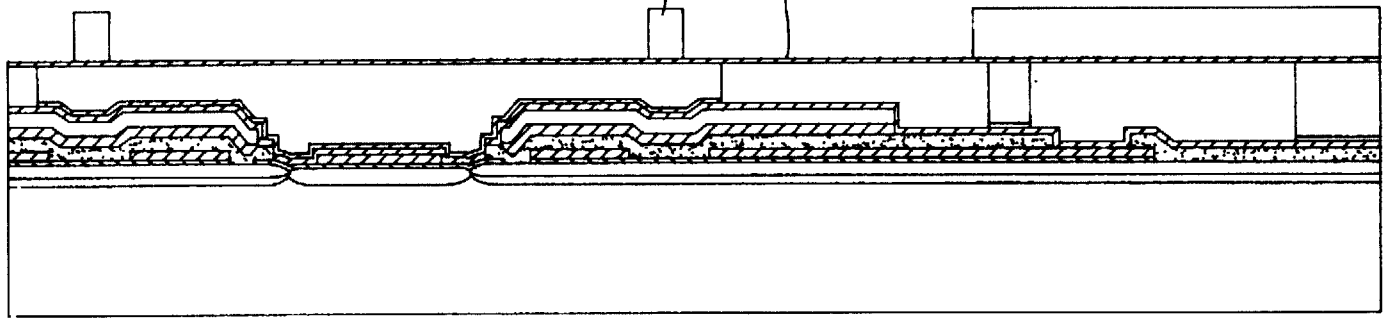
Figure 8E:
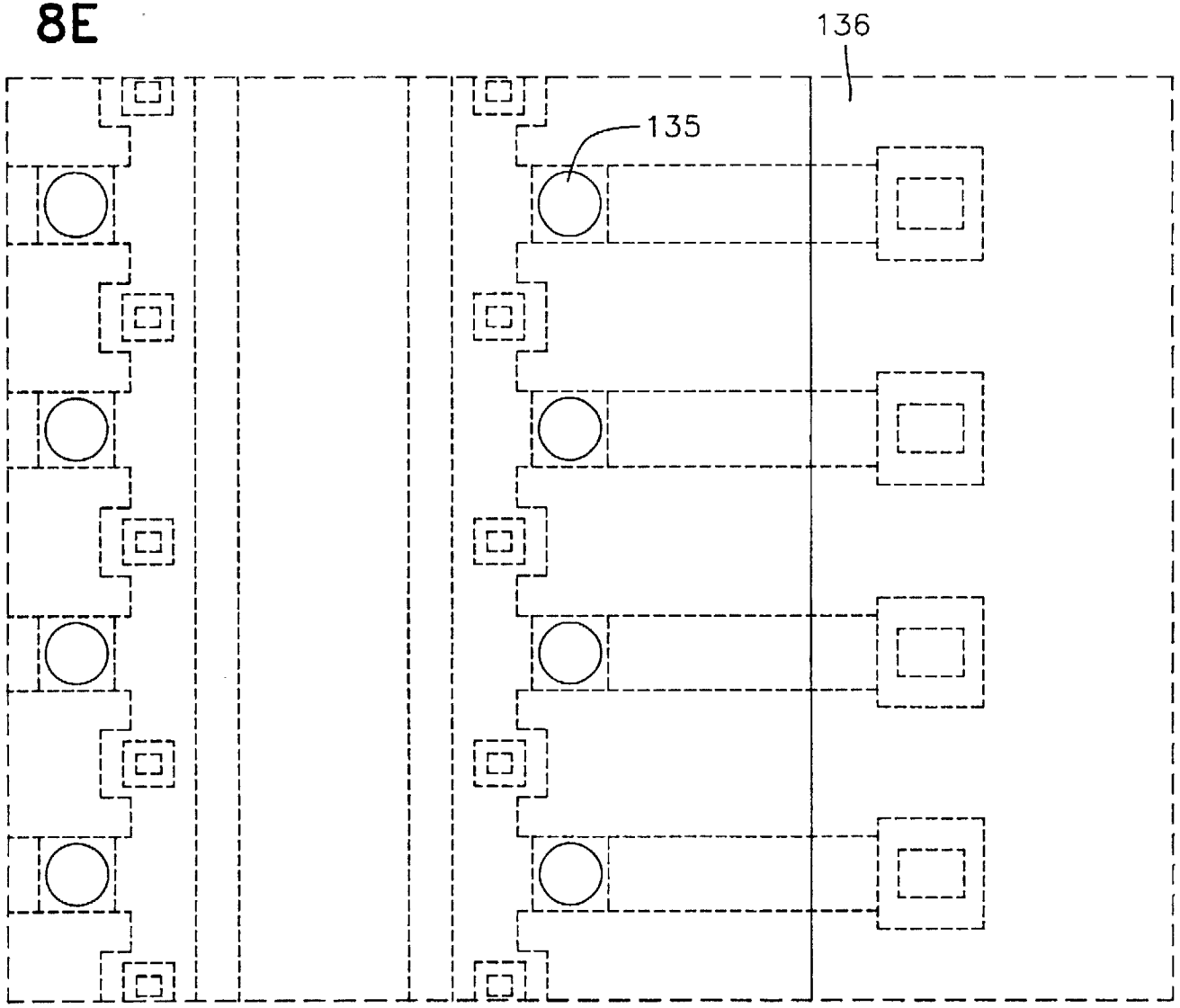

Over the resulting structure, a second seed metal film 99 is then formed, as shown in FIG. 7H. Subsequently, a sacrificial material pattern 100 is formed on a predetermined portion of the second seed metal film 99. As shown in FIG. 8E which is a plan view, the sacrificial material pattern 100 includes circular patterns 135 for shielding the window region defined by the sacrificial material on the independent wires. In the illustrated case, the second seed metal film 99 is comprised of a silver film having a thickness of 0.2 μm. The sacrificial material pattern 100 is comprised of a photoresist film having a thickness of 30 μm.

Figure 7I:
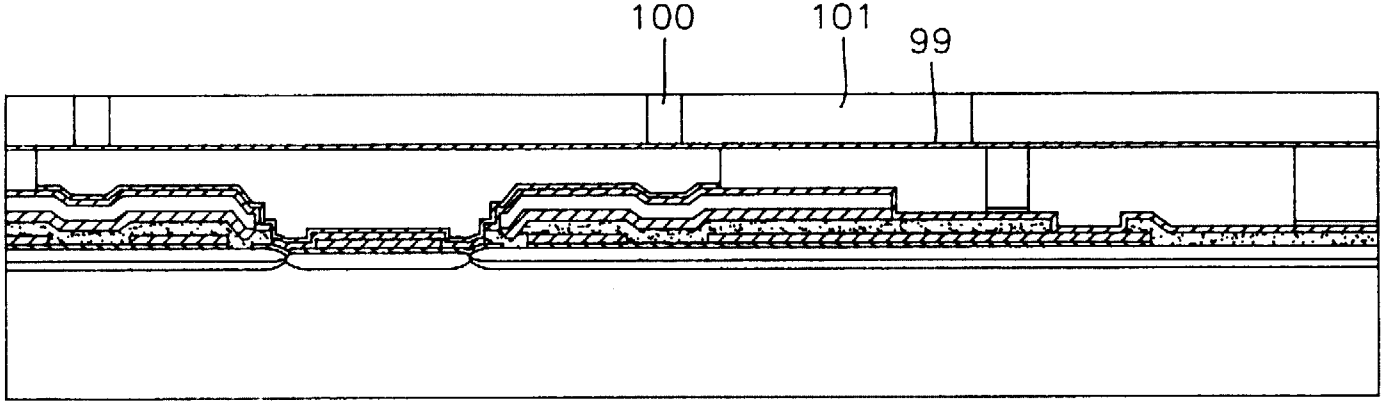
Figure 7J:
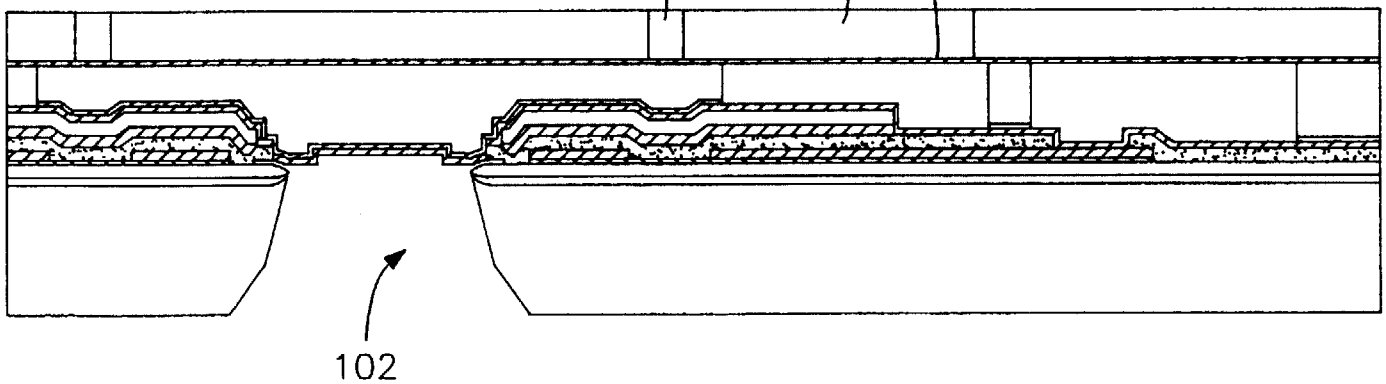

Subsequently, an electroplating film 101 is formed over the exposed portion of the second seed metal film 99 to a thickness corresponding to that of the sacrificial material pattern 100 by supplying a current to the second seed metal film 99, as shown in FIG. 7I. In the above illustrated case, the electroplating films 98 and 101 formed on the seed metal films 96 and 99 are comprised of nickel films, respectively.

Figure 7K:
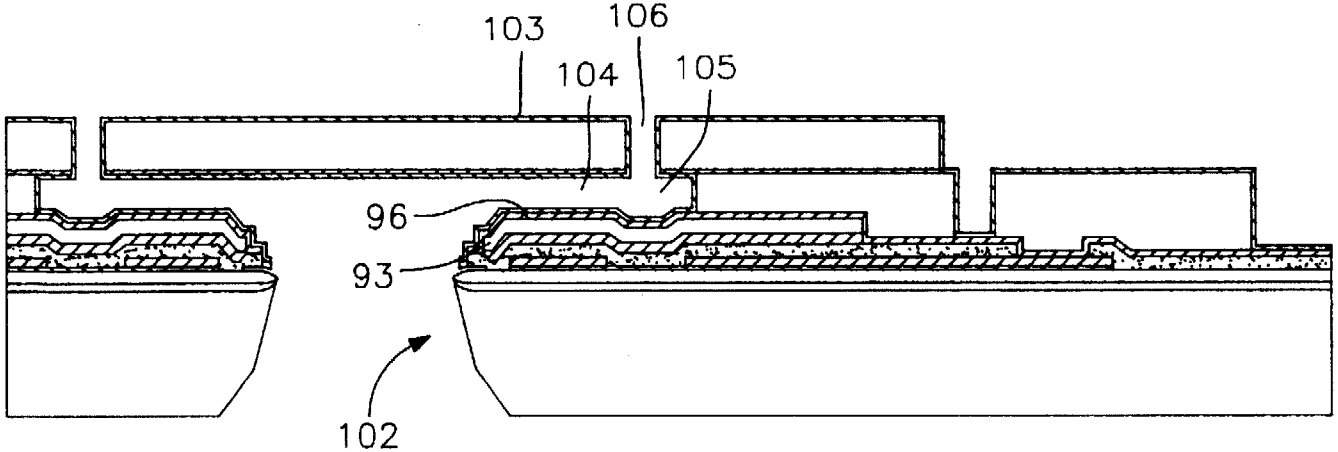

The resulting structure obtained after completing the above process steps is then subjected to an electrolytic polishing step in the same manner as that in the first embodiment of the present invention. At the electrolytic polishing step, the main ink supply passage denoted by the reference numeral 102 is formed to have the same size as that of the window of the first insulating film and extend vertically throughout the substrate 81 at the region where the window is formed, as shown in FIG. 7K.

After completing the above electrolytic polishing step, the sacrificial material patterns 97 and 100 are removed from the structure. Thereafter, a gold plating film 103 is formed over the electroplating films 98 and 101 so as to protect the electroplating films from any erosion by the ink. As a result, the structure is formed with an assistant ink supply passage 104, a micro-chamber 105 and a nozzle 106.

Figure 7L:
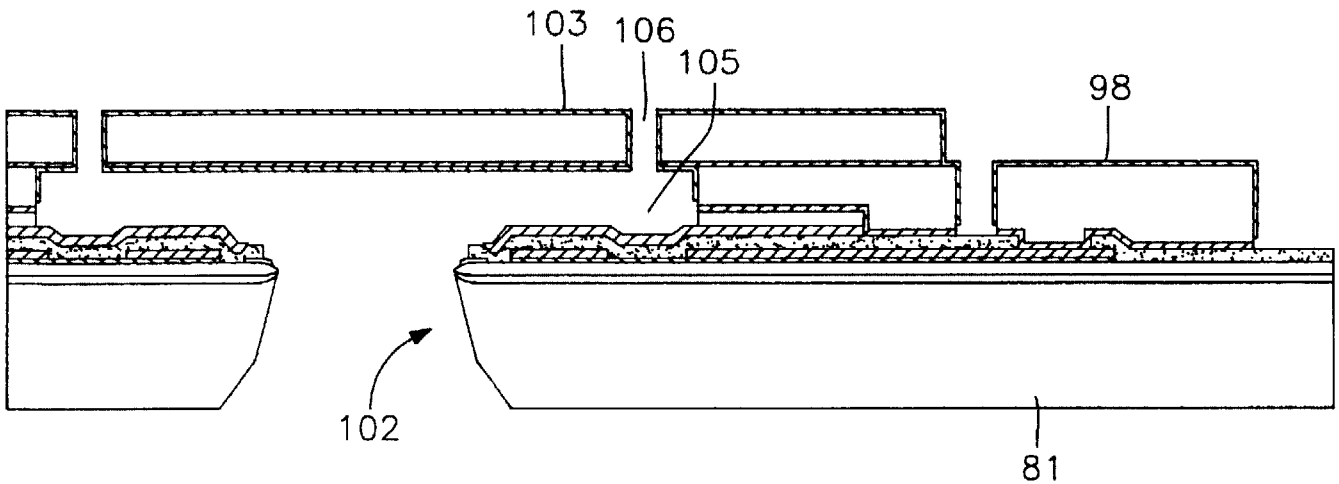

Finally, portions of the seed metal film 96 and insulating film 93 disposed in the micro-chamber 105 are then removed, as shown in FIG. 7L. As a result, a micro ink supply structure extending from the main ink supply passage to the nozzle via the assistant ink supply passage and the micro-chamber is obtained. Thus, a heat-generating type ink-jet print head is obtained.

It is noted that materials of elements used in the second embodiment without being particularly mentioned are the same as those used in the first embodiment, respectively.

As apparent from the above description, the present invention provides a heat-generating type ink-jet print head capable of automatically aligning its main ink supply passage with a heat-generating resistor film formed prior to the main ink supply passage, an assistant ink supply passage and a micro-chamber, forming the main ink supply passage using a non-impact process to have an accurate size, and achieving an accuracy as compared to those fabricated in accordance with the existing laser process or sand striking process. In accordance with the present invention, formation of the main ink supply passage is carried out by the unit of wafer other than the unit of head. This results in a considerable reduction in the manufacture cost, as compared to the existing methods. Moreover, the formation of the nozzle plate is also carried out by the unit of wafer other than the unit of head, without using any separate bonding steps. Accordingly, it is possible to fabricate an inexpensive and superior ink-jet print head.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for fabricating a heat-generating type ink-jet print head using an electrolytic polishing process, comprising the steps of:

forming a non-conductive, first insulating film over a substrate, etching a portion of the first insulating film corresponding to a region where a main ink supply passage is to be formed, thereby forming a first window, and then forming a boron-doped layer on a portion of the substrate exposed through the first window;

sequentially forming a heat-generating resistor film and a wiring on a portion of the first insulating film such that metal films respectively constituting the heat-generating resistor film and wiring are partially disposed in the first window fox an electrical connection to the substrate;

sequentially forming a non-conductive, first protection film, a metal, second protection film, and a non-conductive, second insulating film over the entire exposed surface of the resulting structure obtained after the formation of the wiring, and then locally etching the second insulating film and the second protection film, thereby exposing the main ink supply passage region and a portion of the first protection film;

locally etching the exposed portion of the first protection film, thereby forming second windows respectively at the main ink supply passage region and a region where the wiring is exposed;

forming a seed metal film over the entire exposed surface of the resulting structure obtained after the formation of the second windows, thereby forming pads electrically connected to the wiring;

forming a sacrificial material pattern on a portion of the resulting structure obtained after the formation of the pads, and electroplating an electroplating film on a portion of the seed metal film such that the electroplating film is provided with a third window at a region where a nozzle is to be formed;

removing a portion of the resulting structure obtained after the formation of the third window, which portion is disposed over the main ink supply passage region, by an etching using the electrolytic polishing process, and then removing the sacrificial material pattern; and removing exposed portions of the seed metal film, second insulating film and second protection film, thereby forming an assistant ink supply passage and a micro-chamber together with the nozzle, whereby a micro ink supply structure extending from the main ink supply passage to the nozzle via the assistant ink supply passage and the micro-chamber is formed.

2. A method in accordance with claim 1, wherein further comprising the step of electroplating a gold film over the electroplating film to protect the electroplating film.

3. A method in accordance with claim 1, wherein the first insulating film is comprised of one selected from a group consisting of a silicon oxide film, a silicon nitride film and a silicon carbide film.

4. A method in accordance with claim 1, wherein the boron-doped layer has a boron ion concentration of $10^{18}/cm^3$ or above.

5. A method in accordance with claim 1, wherein the heat-generating resistor film is comprised of one selected from a group consisting of a tantalum/aluminum composite film, a tantalum film and a chromium film.

6. A method in accordance with claim 1, wherein the wiring is made of one selected from a group consisting of aluminum, copper and gold.

7. A method in accordance with claim 1, wherein the first protection film is comprised of one selected from a group consisting of a silicon oxide film, a silicon nitride film, a silicon carbide film and a composite film thereof.

8. A method in accordance with claim 1, wherein the second protection film is made of tantalum or chromium.

9. A method in accordance with claim 1, wherein the second insulating film is comprised of one selected from a group consisting of a silicon oxide film, a silicon nitride film and a silicon carbide film.

10. A method in accordance with claim 1, wherein the seed metal film is comprised of titanium/gold composite film.

11. A method in accordance with claim 1, wherein the sacrificial material pattern is comprised of a photoresist film or a polymer film.

12. A method in accordance with claim 1, wherein the electroplating film is made of nickel or copper.

13. A method in accordance with claim 1, wherein the electrolytic polishing is carried out by applying a voltage across the substrate such that top and bottom surfaces of the substrate act as an anode and a cathode, respectively.

14. A method in accordance with claim 1, wherein the electrolytic polishing is carried out using a solution comprising a fluoric acid/nitric acid/water mixture solution or a fluoric acid/nitric acid/acetic acid mixture solution.

15. A method for fabricating a heat-generating type ink-jet print head using an electrolytic polishing process, comprising the steps of:

sequentially forming a buffer film and a silicon nitride film on a portion of a substrate corresponding to a region where a main ink supply passage is to be formed, and forming an impurity diffusion layer on the other portion of the substrate;

forming a first insulating film over the impurity diffusion layer, removing the silicon nitride film and the buffer film, thereby forming a first window, and then forming a boron-doped layer at the position of the substrate exposed through the first window;

sequentially forming a heat-generating resistor film and a wiring on a portion of the first insulating film such that metal films respectively constituting the heat-generating resistor film and wiring are partially disposed in the first window for an electrical connection to the substrate;

sequentially forming a non-conductive, first protection film, a metal, second protection film and a non-conductive, second insulating film over the entire exposed surface of the resulting structure obtained after the formation of the wiring, and then partially removing the second insulating film and second protection film, thereby exposing the main ink supply passage region and a portion of the first protection film;

locally etching the exposed portion of the first protection film, thereby forming second windows respectively at the main ink supply passage region and a region where the wiring is exposed;

sequentially forming a first seed metal film and a first sacrificial material pattern over the entire exposed surface of the resulting structure obtained after the formation of the second windows, and then removing a portion of the first sacrificial material pattern disposed over a portion of the first seed metal film;

forming an electroplating film over the exposed predetermined portion of the first seed metal film;

forming a second seed metal film over the resulting structure obtained after the formation of the electroplating film, and then forming a second sacrificial material pattern on a portion of the second seed metal film;

forming an electroplating film on an exposed portion of the second seed metal film while supplying a current to the second seed metal film; and etching a bottom surface of the substrate by use of the electrolytic polishing process, and then removing exposed portions of the second sacrificial material pattern, first sacrificial material pattern, second seed metal film, thereby forming an assistant ink supply passage, a micro-chamber and a nozzle.

16. A method in accordance with claim 15, wherein further comprising the step of electroplating a gold film over the electroplating film to protect the electroplating film.

17. A method in accordance with claim 15, wherein the first insulating film is comprised of one selected from a group consisting of a silicon oxide film, a silicon nitride film and a silicon carbide film.

18. A method in accordance with claim 15, wherein the boron-doped layer has a boron ion concentration of $10^{18}/cm^3$ or above.

19. A method in accordance with claim 15, wherein the heat-generating resistor film is comprised of one selected from a group consisting of a tantalum/aluminum composite film, a tantalum film and a chromium film.

20. A method in accordance with claim 15, wherein the wiring is made of one selected from a group consisting of aluminum, copper and gold.

21. A method in accordance with claim 15, wherein the first protection film is comprised of one selected from a group consisting of a silicon oxide film, a silicon nitride film, a silicon carbide film and a composite film thereof.

22. A method in accordance with claim 15, wherein the second protection film is made of tantalum or chromium.

23. A method in accordance with claim 15, wherein the second insulating film is comprised of one selected from a group consisting of a silicon oxide film, a silicon nitride film and a silicon carbide film.

24. A method in accordance with claim 15, wherein the first seed metal film is comprised of a titanium/gold composite film or a chromium film.

25. A method in accordance with claim 15, wherein the first sacrificial material pattern is comprised of a photoresist film or a polymer film.

26. A method in accordance with claim 15, wherein the electroplating film electroplated on the first seed metal film is made of nickel or copper.

27. A method in accordance with claim 15, wherein the second seed metal film is comprised of a titanium/gold composite film or a chromium film.

28. A method in accordance with claim 15, wherein the second sacrificial material pattern is comprised of a photoresist film or a polymer film.

29. A method in accordance with claim 15, wherein the electroplating film electroplated on the second seed metal film is made of nickel or copper.

30. A method in accordance with claim 15, wherein the electrolytic polishing is carried out by applying a voltage across the substrate such that top and bottom surfaces of the substrate act as an anode and a cathode, respectively.

31. A method in accordance with claim 15, wherein the electrolytic polishing is carried out using a solution comprising a fluoric acid/nitric acid/water mixture solution or a fluoric acid/nitric acid/acetic acid mixture solution.

32. A method in accordance with claim 15, wherein the impurity of the impurity diffusion layer is phosphorous ions.

33. A method in accordance with claim 32, wherein the impurity diffusion layer has a phosphorous ion concentration of $10^{18}/cm^3$ or below.

* * * * *

UNITED STATES PATENT AND TRADEMARK OFFICE

CERTIFICATE OF CORRECTION

PATENT NO. : 5,733,433
DATED : March 31, 1998
INVENTOR(S) : Lee et al.

It is certified that error appears in the above-indentified patent and that said Letters Patent is hereby corrected as shown below:

Title page, left column, after "Inventors", insert
--Assignee: QNIX COMPUTER CO., LTD., Seoul, Republic of Korea--

Signed and Sealed this

Twelfth Day of January, 1999

*Attest:*

*Attesting Officer*

*Acting Commissioner of Patents and Trademarks*